US005581628A

United States Patent [19]

Nakamura et al.

[11] Patent Number: 5,581,628

[45] Date of Patent: Dec. 3, 1996

[54] CHARACTERS READING APPARATUS HAVING COLLATING MEANS OF ENVELOPE

[75] Inventors: Yoshikatu Nakamura, Yokosuka; Nobuaki Takagi, Yokohama; Toru Homma, Kawaguchi, all of Japan

[73] Assignee: Kabushiki Kaisha Toshiba, Kawasaki, Japan

[21] Appl. No.: 596,422

[22] Filed: Feb. 2, 1996

Related U.S. Application Data

[63] Continuation of Ser. No. 207,658, Mar. 9, 1994, abandoned.

[30] Foreign Application Priority Data

| | | | |
|---|---|---|---|
| Mar. 23, 1993 | [JP] | Japan | 5-062365 |
| Mar. 25, 1993 | [JP] | Japan | 5-065805 |
| Sep. 21, 1993 | [JP] | Japan | 5-234597 |

[51] Int. Cl.[6] ..... C06K 9/00

[52] U.S. Cl. ..... 382/101; 382/176; 382/224; 382/282

[58] Field of Search ..... 382/101, 102, 382/173, 176, 180, 181, 209, 224, 282, 283

[56] References Cited

U.S. PATENT DOCUMENTS

| | | | |
|---|---|---|---|
| 4,131,879 | 12/1978 | Ehrat | 340/146.3 |
| 4,201,978 | 6/1980 | Nally | 340/146.3 |
| 4,542,829 | 9/1985 | Emery et al. | 382/7 |
| 4,566,127 | 1/1986 | Sekiya et al. | 382/56 |
| 4,773,098 | 9/1988 | Scott | 382/22 |
| 5,025,475 | 6/1991 | Okabe | 382/1 |
| 5,038,392 | 8/1991 | Morris | 382/61 |
| 5,103,489 | 4/1992 | Miette | 382/101 |
| 5,119,433 | 6/1992 | Will | 382/7 |
| 5,307,423 | 4/1994 | Gupta et al. | 382/11 |
| 5,321,470 | 6/1994 | Hasuo et al. | 382/41 |

FOREIGN PATENT DOCUMENTS

| | | | |
|---|---|---|---|
| 3268085 | 11/1991 | Japan | G06K 9/20 |

*Primary Examiner*—Leo Boudreau
*Assistant Examiner*—D. Richard Anderson, Jr.
*Attorney, Agent, or Firm*—Cushman Darby & Cushman, L.L.P.

[57] ABSTRACT

A character reading apparatus including functions for storing size information of an object to be read, an inherent image included in the object, and position information about a read area of the object, from which information is to be read, in advance, in correspondence with each other, functions for scanning the object and obtaining an actual image, functions for measuring a size of the object, functions for comparing an original image corresponding to the size of the object, stored in the storing functions, with the actual image of the object, obtained by the scanning functions, on the basis of the measurement result obtained by the measuring functions, functions for, when the comparing functions determined that the original image coincides with the actual image, determining the position information about the read area, stored in correspondence with the actual image, as a read area of the object, and functions for reading a character from an original image of the read area determined by the read area determining functions.

12 Claims, 30 Drawing Sheets

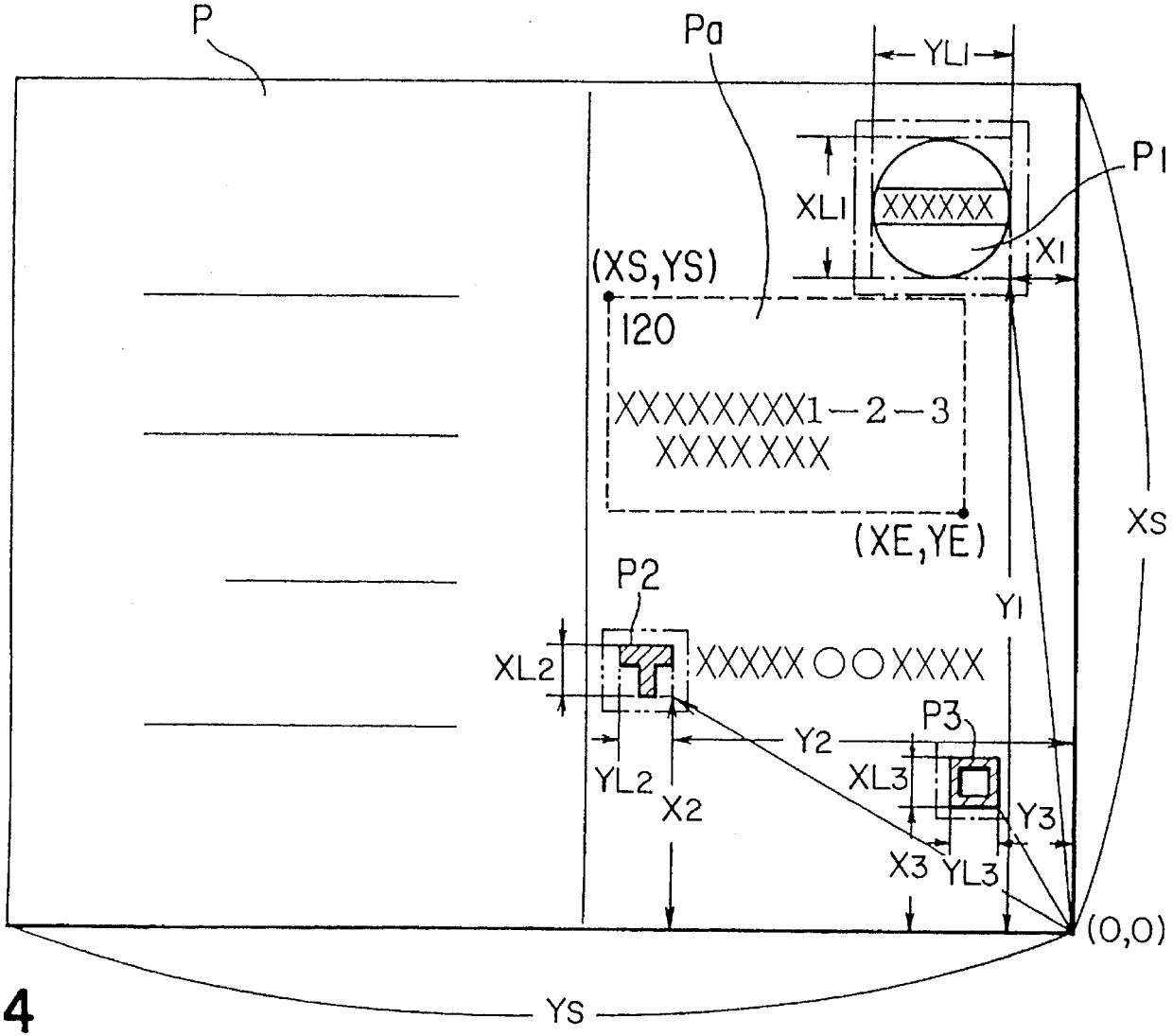
P1
XS
(0,0)
X1
Y1
Y3
YL1
XL1
XXXXXX
XXXXXXX1—2—3
XXXXXXX
(XE,YE)
P3
XL3
X3
YL3
Y2
Pa
(XS,YS)
120
XXXXXX Q
Q3
XX X0000
1234—567
YL3
XL3
XXXXXXXXXXX * * XXX
(X) ○○
ΔΔΔΔΔ
12345
XXX
ΔΔΔ
X X X
X 1, 000, 000—
XXXXXXXXXX

CHARACTERS READING APPARATUS HAVING COLLATING MEANS OF ENVELOPE

This is a continuation of application Ser. No. 08/207,658, filed on Mar. 9, 1994, which was abandoned upon the filing hereof.

BACKGROUND OF THE INVENTION

1. Field of the Invention

The present invention relates to a character reading apparatus for optically reading address information written on mail or optically reading amount information written on a check in, for example, a mail processing apparatus such as an automatic address reading/sorting apparatus for reading address information written on mail and sorting the mail.

2. Description of the Related Art

An automatic apparatus using an optical characters reading technique, for example, an automatic address reading/sorting apparatus for reading address information written on mail, and sorting the mail has; recently been developed and introduced in a post office, e.g., a central post office.

In such an automatic address reading/sorting apparatus, it is very important to properly detect an address information area as a writing position of address information.

In general, however, there are no specific rules of an address information writing method and the like for mail, and hence address information is written at various positions in various directions.

Furthermore, some mail has an advertisement or a postage stamp on the same surface as address information. In such a case, a wrong area is often mistaken for an address information area.

Under the circumstances, for example, in reading address information written on a large quantity of mail (bulk mail), such as notifications of electricity charges and demands for payment of gas charges, which are mailed from specific companies in large quantities in the same format, the respective address information areas are preregistered to allow proper detection of the address information areas.

A conventional technique for a character reading apparatus, for example, is disclosed in Jpn. Pat. Appln. KOKAI Publication No. 3-268085.

In a conventional automatic address reading/sorting apparatus, however, an operator manually selects preregistered contents every time a large quantity of mail from specific companies are sorted. Therefore, the efficiency is very poor, and the load on an operator is high. If switching is not properly performed, the sorting efficiency decreases.

That is, when a large quantity of mail from specific companies are to be sorted, the respective address information areas must be preregistered. In addition, every time a given format is changed, switching of preregistered contents needs to be manually performed. For this purpose, an operator needs to be skilled to a certain degree. Furthermore, the operability is very poor, resulting in a decrease in processing efficiency.

If there are many types of mail, an operation to switch the preregistered contents must be performed frequently. As a result, the operation ratio decreases, and the load on the operator increases, posing difficulties for the operator.

As described above, in the field of character reading apparatuses, such as an automatic address reading/sorting apparatus for reading address information and sorting mail, it is important to properly detect read areas. Improper detection of such areas will lead to a deterioration in read performance.

In addition, a conventional technique of a character reading apparatus, for example, the technique disclosed in U.S. Pat. No. 4,201,978 is known. However, this conventional technique also has the following problems.

As described above, in a conventional character reading apparatus, it is very important to properly detect read areas. Improper detection of such areas will cause a deterioration in the read performance, and hence a deterioration in the performance of an automation apparatus.

In addition, the operability of the conventional character reading apparatuses is very poor, and a decrease in processing efficiency occurs. Moreover, the load on an operator increases.

SUMMARY OF THE INVENTION

It is an object of the present invention to provide a character reading apparatus which can efficiently and accurately detect a read area and can be suitably used for an-automatic apparatus such as an automatic address reading/sorting apparatus, for reading specific information from securities, or the like.

It is another object of the present invention to provide a character reading apparatus which can achieve an improvement in operability and processing efficiency and reduce the load on an operator, and which can be suitably used for reading of address information from specific mail, reading of specific information from securities, or the like.

According to the present invention, there is provided a character reading apparatus comprises: means for storing size information of an object to be read, an inherent image included in the object, and position information about a read area of the object, from which information is to be read, in advance, in correspondence with each other; means for scanning the object and obtaining an actual image; means for measuring a size of the object; means for comparing an original image corresponding to the size of the object, stored in the storing means, with the actual image of the object, obtained by the scanning means, on the basis of the measurement result obtained by the measuring means; means for, when the comparing means determines that the original image coincides with the actual image, determining the position information about the read area, stored in correspondence with the actual image, as a read area of the object; and means for reading a character from an original image of the read area determined by the read area determining means.

According to the present invention, with the above-described arrangement, the following effects can be obtained. The present invention is a character recognition apparatus for handling mail and the like including specific company mail having advertisements and the like printed on the surfaces thereof in addition to addresses. In the present invention, when character written on mail, a preregistered check, or the like are to be read, and a character read portion is to be specified, features including color information and pattern image information are stored in the storing means and are collated with actual images obtained by scanning. Therefore, the comparison/collation processing can be performed more accurately at a higher speed than in a case wherein collation processing is performed by using monochrome images. With this operation, a character read portion can be accurately specified, and an improvement in operability and processing efficiency can be achieved. In addition, the load on a operator can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 4 is a view showing an example of preregistered bulk mail mail according to the first embodiment;

DETAILED DESCRIPTION OF THE PREFERRED EMBODIMENTS

Embodiments of the present invention will be described below with reference to the accompanying drawings.

The first embodiment will now be described.

Figure 16:
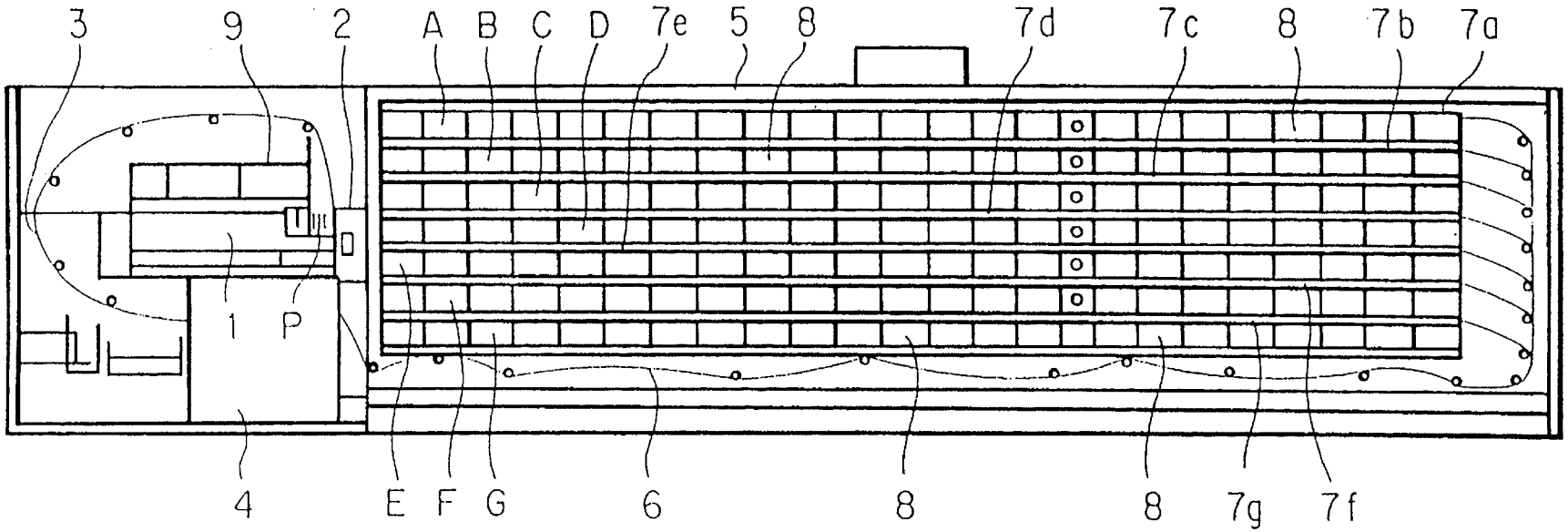
FIG. 16 is a view schematically showing the arrangement of an automatic mail address reading/sorting apparatus according to the first embodiment.

FIG. 16 schematically shows the arrangement of an automatic mail address reading/sorting apparatus according to the first embodiment. This automatic address reading/sorting apparatus comprises a supply section 1, an abstracting section 2, a take-in convey path 3, a reading section 4, and a sorting section 5. In the supply section 1, mail (objects to be read) P as written communications, such as postcards and sealed letters is set, in bulk, in a vertical position. The abstracting section 2 sequentially abstracts the mail P, set in the supply section 1, one by one from the forefront of the mail. The take-in convey path 3 serves to convey the mail P abstracted by the abstracting section 2. The reading section 4 optically reads address information on the mail P conveyed through the take-in convey path 3. The sorting section 5 sorts the mail P, whose address information has been read by the reading section 4, on the basis of the read result (sort designation data).

The sorting section 5 is constituted by a letter convey path 6 for conveying the mail P which has passed through the reading section 4, a plurality of (seven, i.e., A to G in this case) sort convey paths 7*a* to 7*g* arranged in the vertical direction, and a plurality of pockets (collection boxes) 8 arranged along the sort convey paths 7*a* to 7*g*.

Note that an operator panel 9 as an operation panel operated by an operator (mail clerk) is arranged above the supply section 1. Conveyance detectors (not shown) constituted by, e.g., photosensors, are respectively arranged in the convey paths 3, 6, and 7*a* to 7*g* to detect the conveyance of the mail P in the respective convey paths.

The mail P set in the supply section 1 is sequentially abstracted by the abstracting section 2 and is supplied to the reading section 4 through the take-in convey path 3. Address information written on the mail P is then read by the reading section 4.

Subsequently, the mail P is supplied to the sorting section 5 to be selectively conveyed through the letter convey path 6 and one of the sort convey paths 7*a* to 7*g* on the basis of the sort designation data of the mail P. As a result, the mail p is sorted and collected in a predetermined pocket, i.e., one of the pockets 8 which corresponds to the sort designation data.

Figure 1:
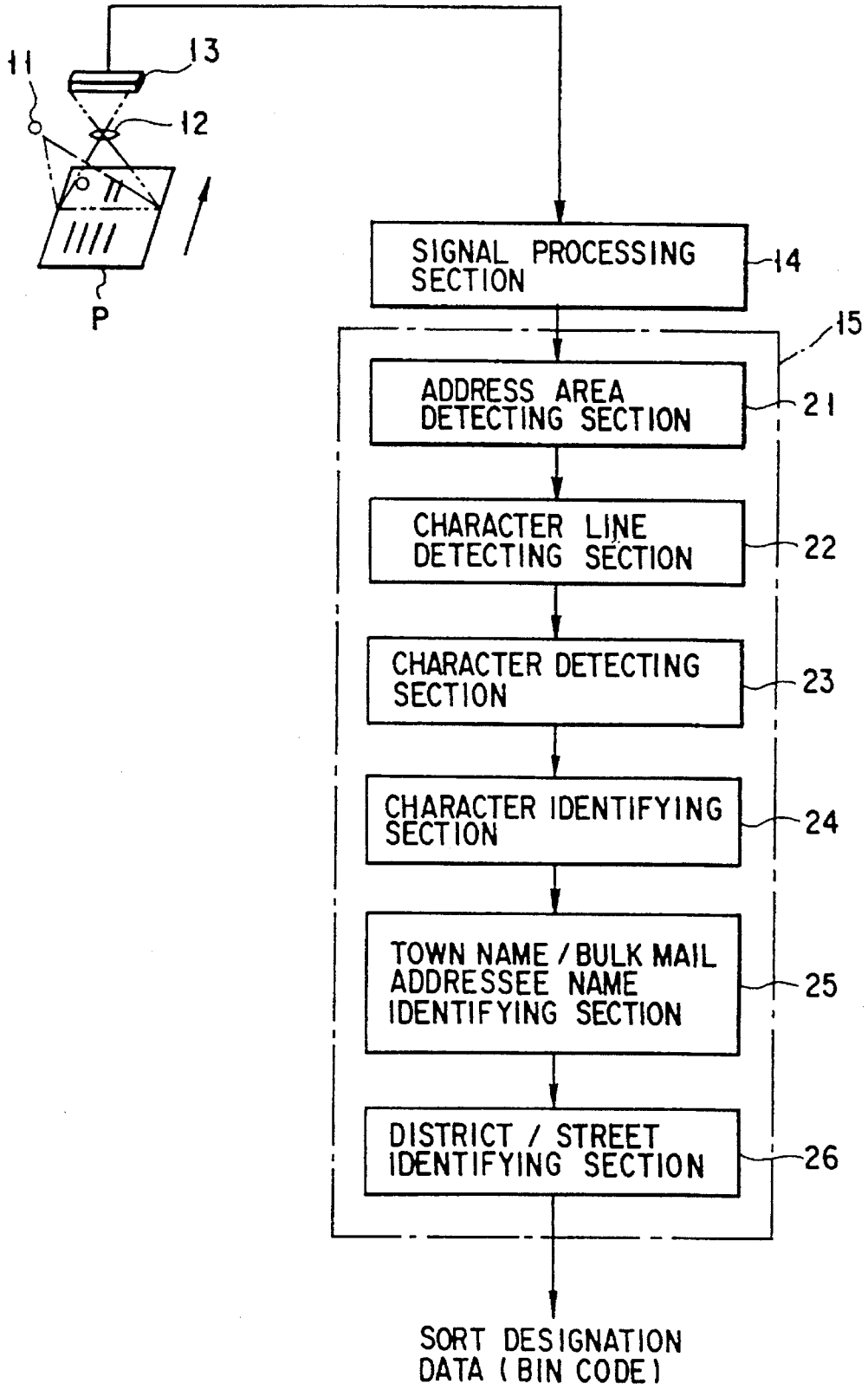
FIG. 1 is a block diagram schematically showing the arrangement of a reading section in an automatic mail address reading/sorting apparatus according to the first embodiment of the present invention.

FIG. 1 schematically shows the arrangement of the above-described reading section 4. The reading section 4 comprises a light source 11, an optical system 12, a self-scanning CCD type line sensor 13, a signal processing section 14, and an identifying section 15. The light source 11 radiates light onto the mail P conveyed in the direction indicated by an arrow in FIG. 1. The optical system 12 receives light reflected by the mail P. The CCD type line sensor 13 converts the light reflected by the mail P and focused through the optical system 12 into an electrical signal. The signal processing section 14 receives an analog signal output from the line sensor 13 and corresponding to an image on the entire surface of the mail P, and performs various kinds of signal processing with respect to the analog signal. The identifying section 15 identifies address information by performing character pattern recognition in accordance with an output from the signal processing section 14.

The signal processing section 14 obtains a pattern signal (read signal) as a detected image by performing amplification processing, emphasis processing, A/D conversion processing, and the like with respect to an analog signal obtained by optically scanning the surface of the mail P on which address information is written.

The identifying section 15 is constituted by an address area detecting section 21, a character line detecting section 22, a character detecting section 23, a character identifying section 24, a town name/bulk mail addressee name identifying section 25, and a district/street identifying section 26.

The address area detecting section 21 detects an area (read area), on which address information is written, from all the information written on the mail P on the basis of the detected image from the signal processing section 14, and outputs image data set within this address information area. A detection method used in this case will be described in detail later.

The character line detecting section 22 receives the image data set within the address information area and detected by the processing performed by the address area detecting section 21, and separates/detects a character line constituting the address information from the image data.

The character detecting section 23 receives image data formed in a single or a plurality of character lines detected by the processing performed by the character line detecting section 22, and separates/detects each character from the image data.

The character identifying section 24 receives the image data obtained by the processing performed by the character detecting section 23 in units of character, and performs identification processing by collating the data with standard patterns prepared in a dictionary (not shown), thus outputting, for example, 10 candidates for each character as identification results.

The town name/bulk mail addressee name identifying section 25 receives the identification results from the character identifying section 24, and evaluates them on the basis of word knowledge (word dictionary) of the names of towns or the names of bulk mail addressees, which are prepared in advance, thereby identifying the name of the town or the name of the bulk mail addressee.

For example, in a processing method in this case, one word is decoded by using a plurality of linked image data and corresponding identification results. In addition, for example, the above-mentioned word knowledge is constituted by the names of towns, cities, and districts, and a word to be detected is finally determined by hierarchical knowledge of address notation.

The district/street identifying section 26 identifies a district/street from image data following the description of the town name recognized by the town name/bulk mail addressee name identifying section 25, and outputs the above-mentioned sort designation data corresponding to the identification result.

In this case, for example, the position of the final image data is determined by the processing performed by the town name/bulk mail addressee name identifying section 25, and the subsequent image data is handled as data representing a district/street.

That is, the character image is detected in more detail on the basis of the image data detected by the processing performed by the character line detecting section 22, assuming that the image data following the town name represents a district/street, and the district/street in the address information area is recognized by the detected position and the identification processing.

The recognition result is then converted into sort designation data (BIN code) for sorting and collecting the mail P in a predetermined pocket 8. The data is output to the sorting section 5. The position of the pocket 8 in the sorting section 5 is indicated by this sort designation data, and the mail P corresponding to the sort designation data is sorted and collected in the pocket 8.

Figures 2, 3:
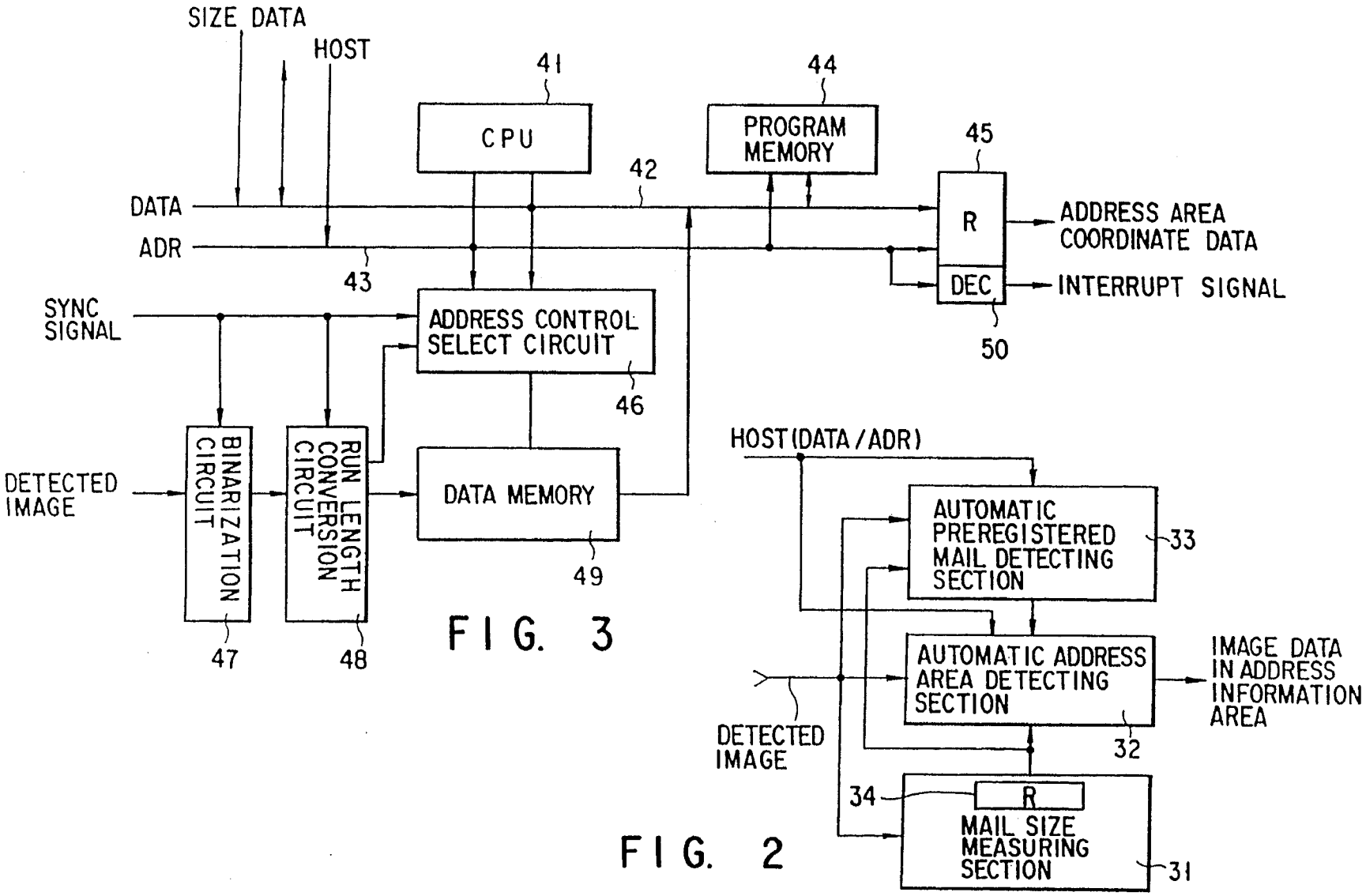
FIG. 2 is a block diagram schematically showing the arrangement of an address area detecting section according to the first embodiment.
FIG. 3 is a block diagram schematically showing the arrangement of an automatic preregistered mail detecting section in the apparatus.

FIG. 2 schematically shows the arrangement of the address area detecting section 21. The address area detecting section 21 comprises a mail size measuring section 31, an address area self-detecting section 32, and an automatic preregistered mail detecting section 33.

The mail size measuring section 31 measures the vertical and horizontal lengths of the mail P on the basis of the detected image supplied from the signal processing section 14 and corresponding to the mail P. In this case, the vertical length (length in the conveying direction) of the mail P is obtained from passage detection information, e.g., the time taken for the passage of the leading and trailing ends of the mail P, which is detected by a conveyance detector (not shown) arranged on the take-in convey path 3, and the convey speed. The horizontal length (length in a direction perpendicular to the conveying direction) of the mail P is calculated by the ratio of the vertical length to the horizontal length of the detected image.

In this embodiment, the mail size measuring section 31 operates in synchronism with the transfer of each detected image. When input of all the detected images of the mail P is completed, the mail size measuring section 31 stores the vertical and horizontal lengths (size data) in an internal register (R) 34. This size data is supplied from the mail size measuring section 31 to the address area self-detecting section 32 and the automatic preregistered mail detecting section 33, as needed.

The address area self-detecting section 32 measures the spatial density of a character image obtained by binarization processing of the detected image on the basis of the size data from the mail size measuring section 31 and the detected image from the signal processing section 14, and obtains an address information area on the mail P corresponding to the detected image from the measurement result.

In addition, the address area self-detecting section 32 outputs image data on the detected image corresponding to the address information area obtained by itself to the character line detecting section 22. Alternatively, image data on the detected image corresponding to coordinate data (to be described later) supplied from the automatic preregistered mail detecting section 33 is output to the character line detecting section 22 in preference to the above-mentioned image data. The address area self-detecting section 32 will be described in detail later.

The automatic preregistered mail detecting section 33 receives the size data from the mail size measuring section 31 and the detected image from the signal processing section 14, and compares them with each preregistered mail size and inherent feature information on this preregistered mail to detect whether the mail P is preregistered mail.

If the mail P is preregistered mail, coordinate data representing the position of the address information area on the preregistered mail is output to the address area self-detecting section 32. Thereafter, image data on the partial circuit corresponding to the coordinate data is output as image data within the address information area of the mail P. The automatic preregistered mail detecting section 33 will be described in detail later.

Note that the address area self-detecting section 32 and the automatic preregistered mail detecting section 33 are operated in accordance with commands from a host computer (HOST) (not shown).

FIG. 3 schematically shows the arrangement of the automatic preregistered mail detecting section 33. The automatic preregistered mail detecting section 33 comprises a CPU 41 for performing overall control, and a program memory 44, a register (R) 45, and an address control select circuit 46 which are connected to the CPU 41 through a data bus (DATA) 42 and an address bus (ADR) 43. In addition, the automatic preregistered mail detecting section 33 comprises a binarization circuit 47, a run length conversion circuit 48, and a data memory 49.

The mail size measuring section 31 is connected to the data bus 42 to receive size data therefrom. A host computer (HOST) (not shown) is connected to the data bus 42 and the address bus 43.

The binarization circuit 47 receives a detected multi-value image from the signal processing section 14 together with the corresponding sync signal (a horizontal sync signal and an image sync signal for each line scanning), and converts the image into a binary image signal of (1, 0).

The run length conversion circuit 48 receives the binary image signal processed by the binarization circuit 47 in accordance with the sync signal, and performs run length conversion of the signal.

The data memory 49 stores the run length data, obtained by run length conversion performed by the run length conversion circuit 48, under the control of the address control select circuit 46. In addition, the stored run length data is read out from the data memory 49 under the control of the address control select circuit 46 to be output onto the data bus 42.

The address control select circuit 46 receives the output from the run length conversion circuit 48 in accordance with the above-mentioned sync signal, and also controls a write or read operation with respect to the data memory 49 in accordance with commands from the CPU 41 which are supplied through the data bus 42 and the address bus 43.

The register 45 stores coordinate data representing the position of the address information area of each preregistered mail which is to be output to the address area self-detecting section 32, and has a decoder (DEC) 50 for generating an interrupt signal for performing interruption to output the coordinate data.

The program memory 44 stores program data and the like for causing the CPU 41 to perform a sequential operation. Although this program memory 44 is designed to allow data from the host computer to be written through the data bus 42, the memory can also be realized by a ROM in which data are written in advance.

The CPU 41 operates in accordance with the contents of the program memory 44 to control the address control select circuit 46. In addition, on the basis of run length data read out from an arbitrary position in the data memory 49 through the data bus 42, the CPU 41 detects whether given mail is the above-mentioned preregistered mail. If the given mail is the preregistered mail, the CPU 41 stores coordinate data representing the position of the address information area in the register 45.

A logic of identification determination for detecting whether the mail P, from which an image has already been detected, is preregistered mail will be described below.

FIG. 4 shows an example of bulk mail P to be preregistered as preregistered mail. In this case, in addition to address information Pa indicating the postal code, address, and name of an addressee, feature information on the mail P, such as a postage stamp p1 and marks P2 and P3 of the waterworks Bureau as an addresser are pre-printed on the mail P.

Figure 5:
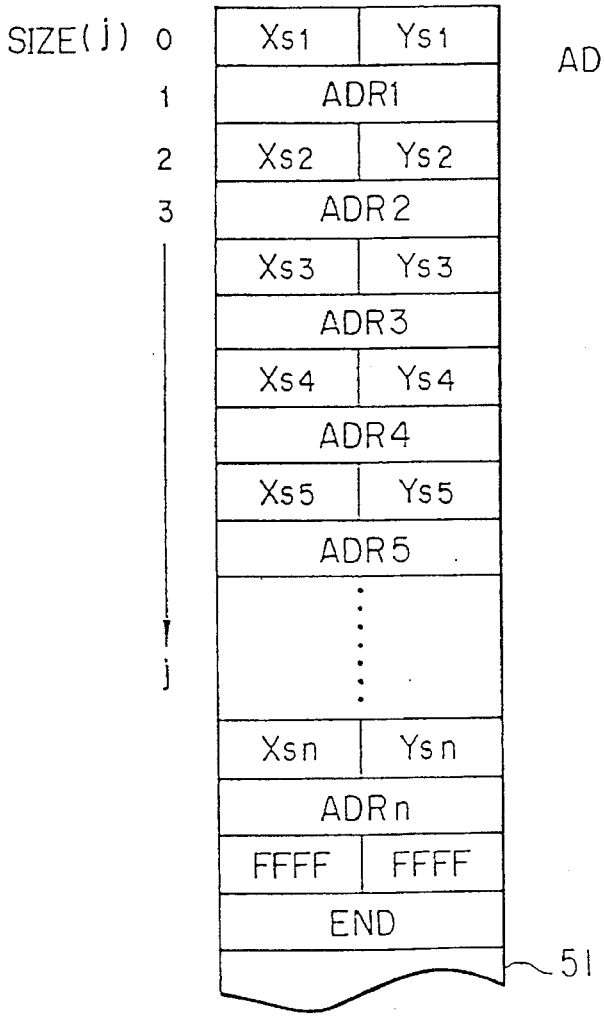
FIG. 5 is a chart showing an example of the arrangement of a size management table according to the first embodiment.
Figure 6:
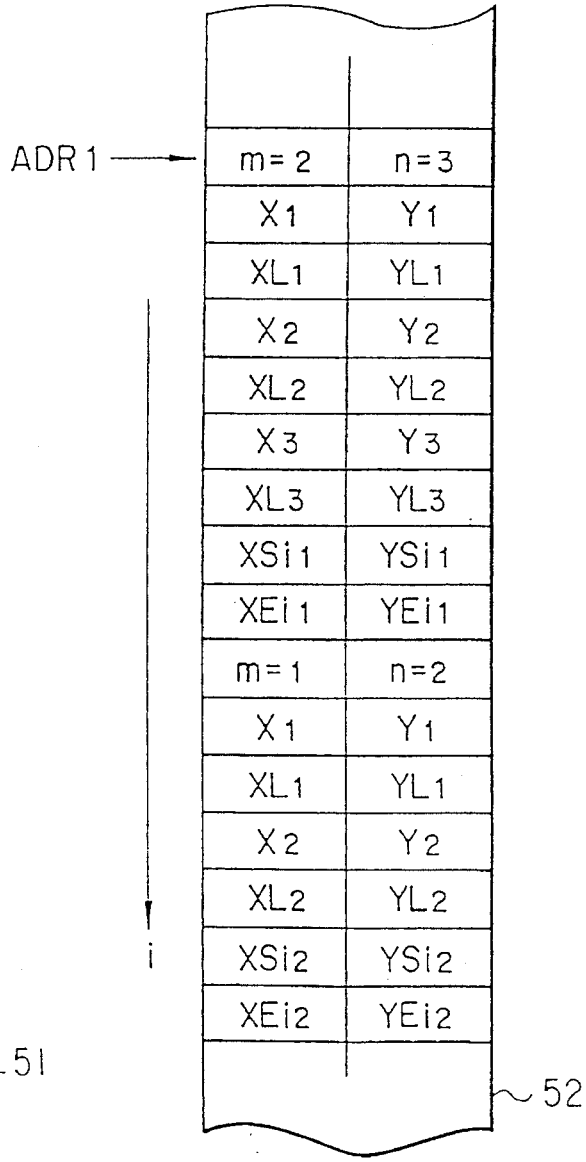
FIG. 6 is a chart showing an example of the arrangement of a feature management table according to the first embodiment.

FIGS. 5 and 6 show management tables for managing the contents of preregistered mail. For example, a size management table 51 having an address termed "SIZE" as a start address, and a feature management table 52 having an address termed "ADR" as a start address are stored in the program memory 44.

For example, as shown in FIG. 5, in the size management table 51, sizes (Xsn, Ysn) of mail preregistered as preregistered mail and start addresses (ADRn), of the feature management table 52, which are used to manage the positions and the like of feature information as fixed, pre-printed images on mail are paired.

More specifically, as preregistered mail having the same size as that of the mail P whose image has been detected, mail having a size defined by "Xs1, Ys1" is preregistered, and the feature information of the preregistered mail is stored at an address position defined by "ADR1" of the feature management table 52.

For example, as shown in FIG. 6, the feature management table 52 serves to store positions (Xn, Yn) and sizes (XLn, YLn) of pieces of feature information on preregistered mail, and coordinate data {(Xsin, YSin), (XEin, YEin)} indicating the positions of the address information areas of the preregistered mail, together with a number (m) of types of preregistered mail and a number (n) of pieces of feature information corresponding to the preregistered mail.

Assume that access is made with respect to an address (ADR1). In this case, for example, there are two types of preregistered mail having the same size as that of the mail P, and the first type of preregistered mail has three pieces of feature information P1, P2, and P3. In addition, positions (X1, Y1), (X2, Y2), and (X3, Y3) of the pieces of feature information P1, P2, and P3 with respect to a reference point (0, 0), and their sizes (XL1, YL1), (XL2, YL2), and (XL3, YL3) can be known. Furthermore, coordinate data {((XSi1, YSi1), (XEi1, YEi1)} indicating a position {(XS, YS), (XE, YE)} of the address information area of the preregistered mail can be known.

Similarly, that the second type of preregistered mail has two pieces of feature information P1 and P2, and their positions (X1, Y1) and (X2, Y2) with respect to a reference point (0, 0) can be known. In addition, sizes (XL1, YL1) and (XL2, YL2) of the pieces of feature information, and coordinate data {(XSi2, YSi2), (XEi2, YEi2)} indicating a position {(XS, YS), (XE, YE)} of the address information area of the preregistered mail can be known.

Figure 7:
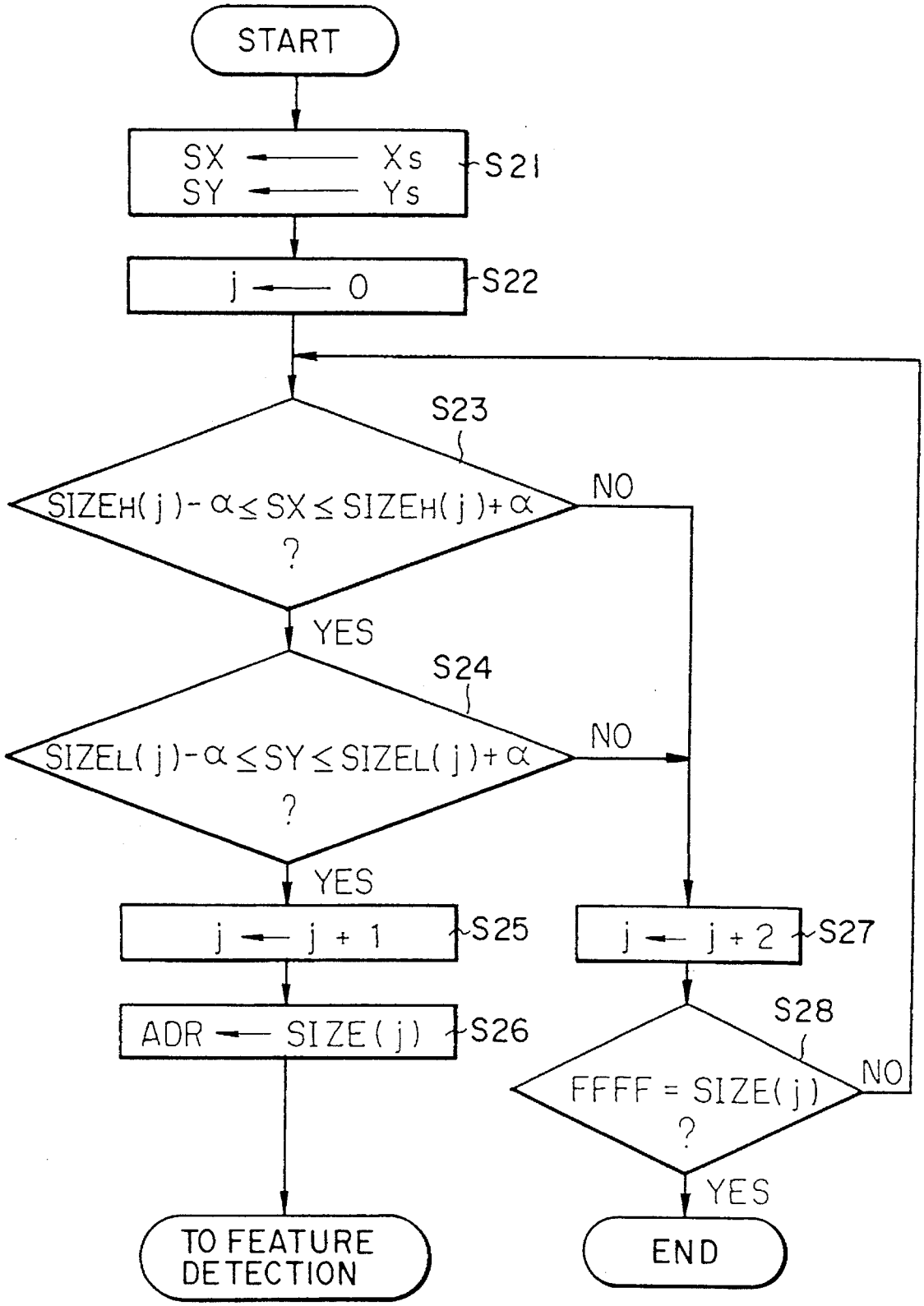
FIG. 7 is a flow chart for explaining the flow of processing associated with detection of preregistered mail according to the first embodiment.

FIG. 7 shows the flow of processing associated with detection of preregistered mail. Assume that the size of the mail P whose image has been detected is measured by the mail size measuring section 31, and size data (Xs, Ys) as the measurement value is supplied to the automatic preregistered mail detecting section 33. In this case, the size data (Xs, Ys) is input to the CPU 41 through the data bus 42 and is stored in internal registers SX and SY. Thereafter, the respective data in the size management table 51 stored in the program memory 44 are sequentially retrieved in accordance with the contents of the registers SX and SY to check a coincidence.

In this case, the identity of the size data (Xs, Ys) stored in the registers SX and SY is determined with respect to the size (Xsn, Ysn) of each mail preregistered in the size management table 51 within a certain range of errors ($\pm\alpha$). That is, it is detected whether any mail having substantially the same size as that of the mail P whose image has been detected is present as preregistered mail.

This determination of identity is performed with respect to all the sizes (Xsn, Ysn) in the table 51. Every time a coincidence is determined, access is made with respect to an address (ADRn), in the feature management table 52, which corresponds to the corresponding size.

If, for example, it is determined that the size data coincides with the size (Xs1, Ys1) in the size management table 51 shown in FIG. 5, access is made with respect to the corresponding address (ADR1) in the feature management table 52.

Note that if no coincidence is determined up to the end of the data of the size management table 51, it is determined that the mail P is not preregistered mail. In this case, the processing is completed, and a wait state is kept until the image of the next mail P is detected.

Figure 8:
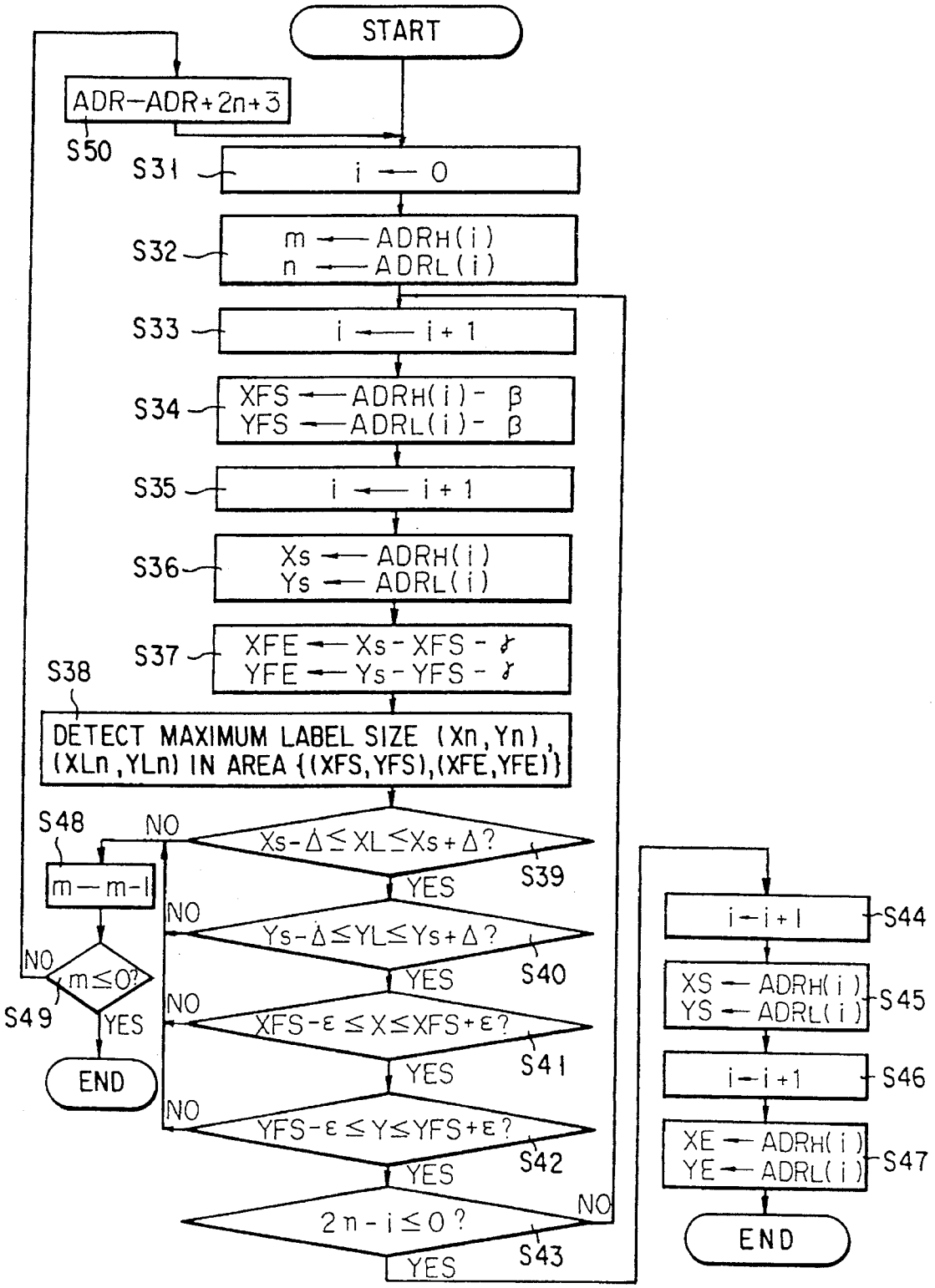
FIG. 8 is a flow chart for explaining the flow of processing associated with detection of features of mail according to the first embodiment.

FIG. 8 shows the flow of processing associated with detection of the features of the mail P. When it is detected by the above-described detection processing of preregistered mail that there is preregistered mail having the same size as that of the mail P, it is checked by referring to the feature management table 52 shown in FIG. 6 whether all pieces of preregistered feature information coincide with those of the mail P.

In this embodiment, for example, determination of coincidence is performed by using the size of a block of feature information labeled on the basis of binarized run length data, and the position (X- and Y-coordinate values) of the block with respect to a reference point.

Assume that it is detected by the above-described determination of identity that there is preregistered mail having the same size as that of the mail P. In this case, run length data stored in the data memory 49 is read out by the CPU 41 through the address control select circuit 46, labeling processing is performed with respect to the run length data (steps S31, S32, S33, S34, S35, S36, S37, and S38).

It is then checked, within a certain range of errors ($-\beta$, $+\gamma\pm\Delta$, $\pm\epsilon$), whether each block of feature information obtained by the above-mentioned labeling processing coincides with each block indicated by a position (Xn, Yn), in the feature management table 52, which corresponds to an address (ADRn) of the size for which identity is determined, and a size (XLn, YLn) (S39, S40, S41, S42, and S43).

In this case, pieces of feature information corresponding to the mail P are processed by using data of the maximum block (the maximum label size (Xn, Yn), (XLn, YLn)) in a predetermined area {(XFS, YFS), (XFE, YFE)} after labeling processing.

Assume that access is made with respect to address ADR1 in the feature management table 52 shown in FIG. 6. In this case, it is checked whether the pieces of feature information on the mail P, i.e., the positions and sizes of the maximum blocks, of the pieces of feature information obtained by the above-mentioned labeling processing, in predetermined areas, coincide with the three pieces of feature information P1, P2, and P3 corresponding to the first type of preregistered mail represented by the positions (X1, Y1), (X2, Y2), (X3, Y3) and the sizes (XL1, YL1), (XL2, YL2), and (XL3, YL3).

If, for example, it is determined that all the pieces of feature information coincide with the corresponding pieces of information, the coordinate data {(XSi1, YSi1), (XEi1, YEi1)} indicating the position of the address information area of this preregistered mail is output to the address area self-detecting section 32 through the register 45, by an interrupt operation, as the coordinate data {(XS, YS), (XE, YE)} indicating the position of the address information area of the mail P (steps S44, S45, S46, and S47). The processing in this case is then completed.

If at least one of the three pieces of feature information P1, P2, and P3 corresponding to the first type of preregistered mail does not coincide with the corresponding information, it is checked whether the pieces of feature information on the mail P coincide with the two pieces of feature information P1 and P2 corresponding to the second type of preregistered mail, which follows the first type of preregistered mail.

If it is determined that the two pieces of feature information coincide with the corresponding pieces of information, the coordinate data {(XSi2, YSi2), (XEi2, YEi2)} indicating the position of the address information area of this preregistered mail is output as the coordinate data {(XS, YS), (XE, YE)} indicating the position of the address information area of the mail P. The processing in this case is then completed.

If at least one of the two pieces of feature information does not coincide with the corresponding information, it is determined that the mail P is not preregistered mail. That is, processing of "m←m−1" is performed to set "m=0", and the processing in this case is then completed (steps S48 and S49). A wait state is kept until the image of the next mail P is detected (step S50).

A method of abstracting the maximum block in a predetermined area of the above-mention feature information will be described below.

Figure 9:
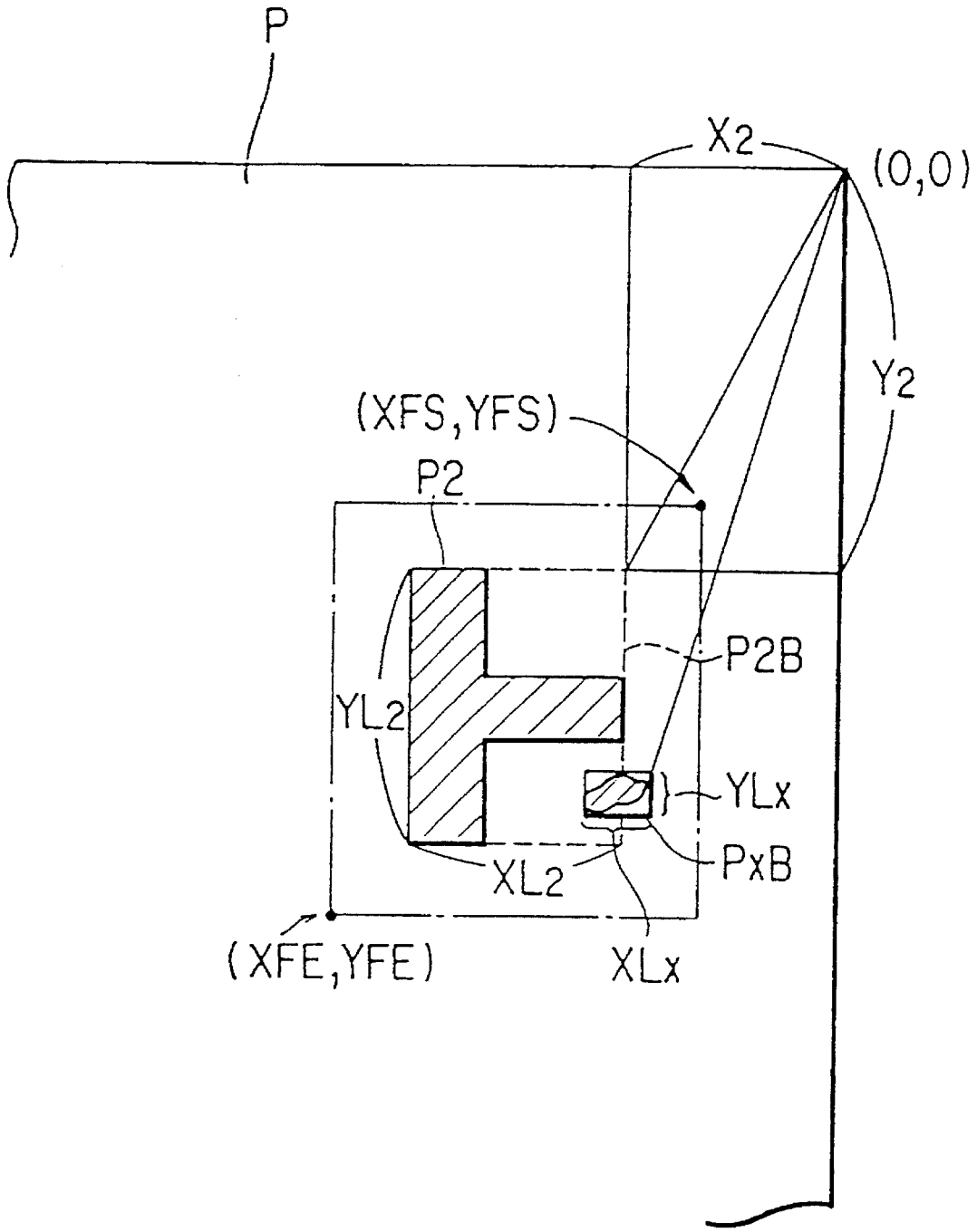
FIG. 9 is a view for explaining a method of abstracting the maximum block in a predetermined area according to the first embodiment.

FIG. 9 shows processing to be performed when a plurality of blocks are detected in a predetermined area. Assume that a block P2B of the feature information P2 and another block PxB are detected in a predetermined area {(XFS, YFS), (XFE, YFE)}. In this case, the areas of the blocks P2B and PxB are obtained from the sizes (XL2, YL2) and (XLx, YLx) of the respective blocks.

In this case, since the block P2B has the maximum area, a position (X2, Y2) of an outer frame surrounding the block P2B having the size (XL2, YL2) with respect to a reference point (0, 0) is preregistered in the feature management table 52 in advance.

Figure 10:
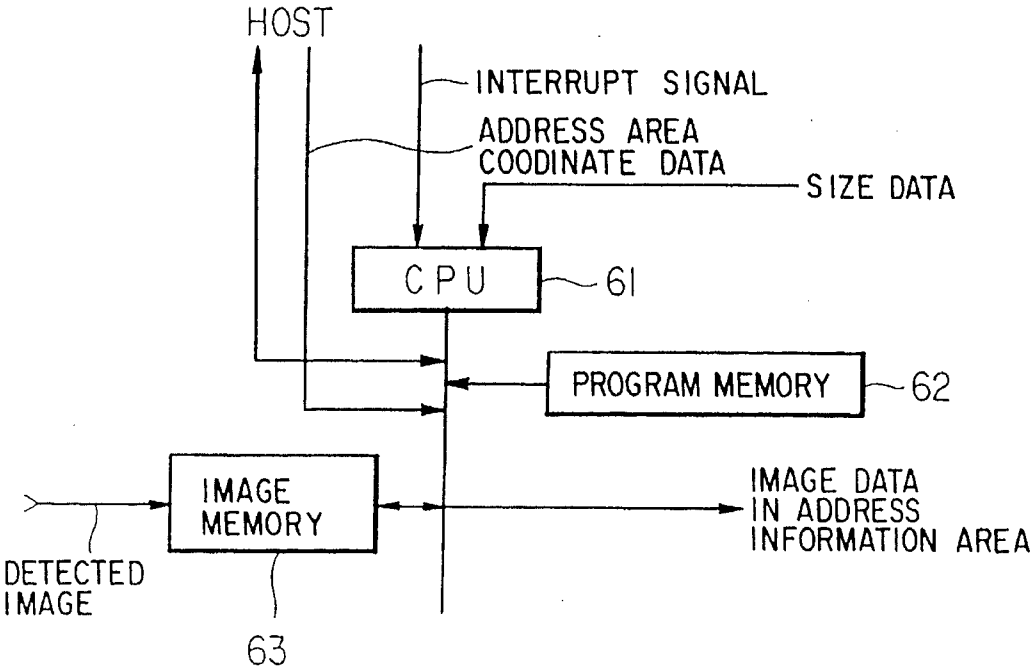
FIG. 10 is a block diagram schematically showing the arrangement of an address area self-detecting section according to the first embodiment.

FIG. 10 schematically shows the arrangement of the address area self-detecting section 32. The address area self-detecting section 32 comprises a CPU 61 for performing overall control, a program memory 62 for storing program data and the like for causing the CPU 61 to perform a predetermined operation, and an image memory 63 for storing a detected image from the signal processing section 14.

The CPU 61 has a register (not shown) for saving address area coordinate data supplied in response to an interrupt signal from the automatic preregistered mail detecting section 33. At the same time, when input of a detection signal to the image memory 63 is completed, the CPU 61 operates in accordance with an address detection program stored in the program memory 62 to start detection of the address information area of the mail P. In addition, the CPU 61 abstracts image data in the area from the detected image stored in the image memory 63, and outputs it to the character line detecting section 22.

Figure 11:
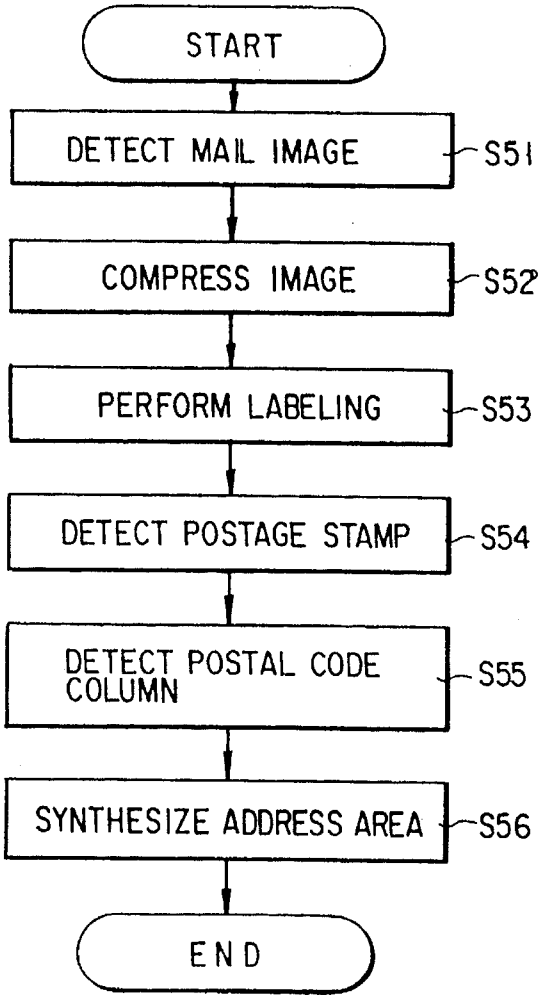
FIG. 11 is a flow chart showing the flow of processing based on an address area self-detection program according to the first embodiment.

An operation associated with address area self-detection will be described below with reference to FIGS. 11 to 15. FIG. 11 schematically shows the flow of processing performed in accordance with an address area self-detection program. FIGS. 12 to 15 show examples of how mail images are handled in this processing.

First, an image of the mail P is detected by the signal processing section 14 (step S51). The detected image (see FIG. 12) is then subjected to image compression processing (step S52) to be converted into a compressed image (see FIG. 13). By performing labeling processing with respect to this compressed image, feature information (see FIG. 14) is obtained.

A postage stamp surface and a postal code column on the mail p are detected from this feature information by using pieces of information on the sizes and positions of label blocks (steps S54 and S55). By detecting/synthesizing a label block constituting address character from pieces of information on the sizes and positions of the remaining label blocks (step S56), an address area (see FIG. 15) is detected.

Upon reception of an interrupt signal from the automatic preregistered mail detecting section 33, the CPU 61 stops the detection operation based on the address detection program. At the same time, the CPU 61 abstracts image data on the detected image stored in the image memory 63 in accordance with the address area coordinate data saved by the above-mentioned register (not shown), and outputs it to the character line detecting section 22.

As described above, in the address area self-detecting section 32, either when an address information area is detected by the automatic preregistered mail detecting section 33 or when self-detection is performed, the processing is completed after image data is transferred. A wait state is then kept until an image of the next mail P is detected.

Note that if the mail P is preregistered mail, since the start and end coordinates of an address information area are known in advance, image data is transferred from the start coordinates with the Y and x directions being respectively regarded as the main scanning and sub-scanning directions.

In this manner, the image data of the address information area detected by self-detection on the basis of the spatial density of the character image, or the image data of the address information area based on determination with respect to preregistered mail, is supplied, as an output from the address area detecting section 21, to the character line detecting section 22. With this operation, sort processing by the above-described address recognition is automatically performed.

As described above, whether given mail is preregistered mail can be determined without requiring an input operation of an operator. That is, whether the mail is preregistered mail can be discriminated by detecting partial features of the mail and comparing them with features of preregistered mail.

With this operation, if the mail is preregistered mail, coordinate data indicating the position of the address information area of the preregistered mail is output as the address information area of the mail in preference to a conventional address area self-detection output. This allows switching of read formats and areas from which data are to be automatically read.

Therefore, when bulk mail which are mailed in large quantities in the same format, are to be processed, even if mail of other formats is included in the bulk mail, perfect automation of processing and continuous processing can be realized, thus improving the operation efficiency of the operator and the processing performance.

In addition, determination of identity of mail can be performed by very simple processing, and data for determination (feature information) can be easily preregistered. Therefore, excellent processing effects can be expected.

In the first embodiment, the present invention is applied to the automatic mail address reading/sorting apparatus. However, the present invention is not limited to this. For example, the present invention can be equally applied to a general optical character reading apparatus and various types of character reading apparatuses using a two-dimensional image input apparatus and the like.

The second embodiment of the present invention will be described below.

In the second embodiment, the present invention is applied to a character reading apparatus for optically reading amount information written on a check (securities). Since the second embodiment has almost the same arrangement as that of the first embodiment except for a reading section 4, only the reading section 4 will be described in detail below. The same reference numerals in the second embodiment denote the same parts as in the first embodiment, and a detailed description thereof will be omitted, and only different portions will be described in detail.

Figure 17:
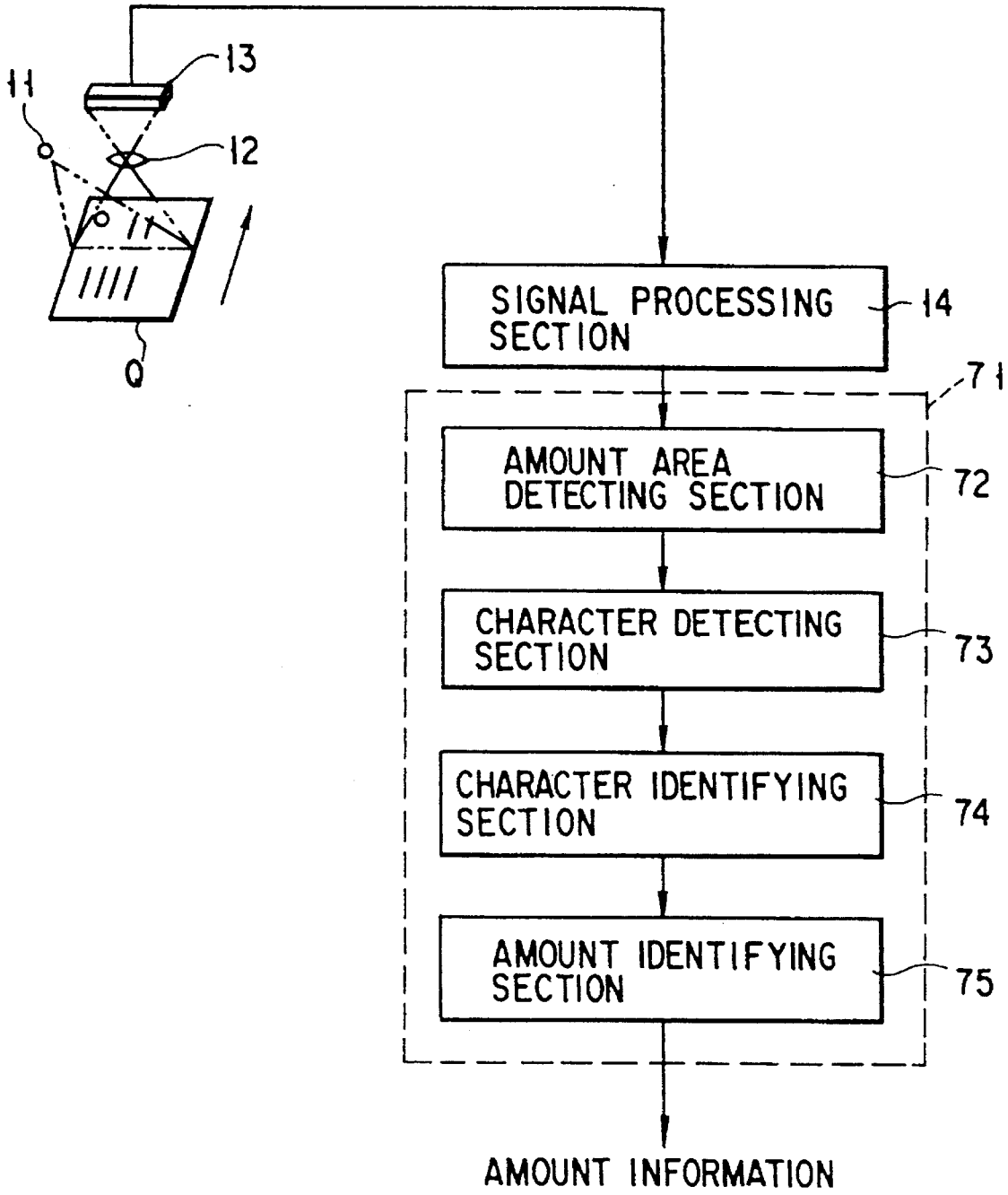
FIG. 17 is a block diagram schematically showing the arrangement of a reading section according to the second embodiment of the present invention.

FIG. 17 schematically shows the arrangement of the reading section 4 for reading amount information of a check. The reading section 4 comprises a light source 11, an optical system 12, a self-scanning type CCD type line sensor 13, a signal processing section 14, and an identifying section 71. The light source 11 radiates light onto a check Q conveyed in the direction indicated by an arrow in FIG. 17. The optical system 12 receives light reflected by the check Q. The CCD type line sensor 13 converts the light reflected by the check Q and focused through the optical system 12 into an electrical signal. The signal processing section 14 receives an analog signal output from the CCD type line sensor 13 and corresponding to an image on the entire surface of the check Q, and performs various kinds of signal processing with respect to the analog signal. The identifying section 71 identifies amount information by performing character pattern recognition in accordance with an output from the signal processing section 14.

The signal processing section 14 obtains a pattern signal (read signal) as a detected image by performing amplification processing, emphasis processing, A/D conversion processing, and the like with respect to an analog signal obtained by optically scanning the surface of the check Q on which information is written.

The identifying section 71 comprises an amount area detecting section 72, a character detecting section 73, a character identifying section 74, and an amount identifying section 75.

The amount area detecting section 72 detects an area (read area) in which amount information is written from all information written on the check Q on the basis of the detected image from the signal processing section 14, and outputs image data in this amount information area. Note that a detection method used in this case will be described in detail later.

The character detecting section 73 receives the image data in the amount area detected by the processing performed by the amount area detecting section 72, and separates/outputs the data in units of character.

The character identifying section 74 receives the image data obtained, in units of character, by the processing performed by the character detecting section 73, and performs identification processing by collating the input data with standard patterns prepared in a dictionary (not shown), thus outputting each character candidate as an identification result.

The amount identifying section 75 obtains amount information from each character identification result obtained by the character identifying section 74, and outputs the amount information.

Figure 18:
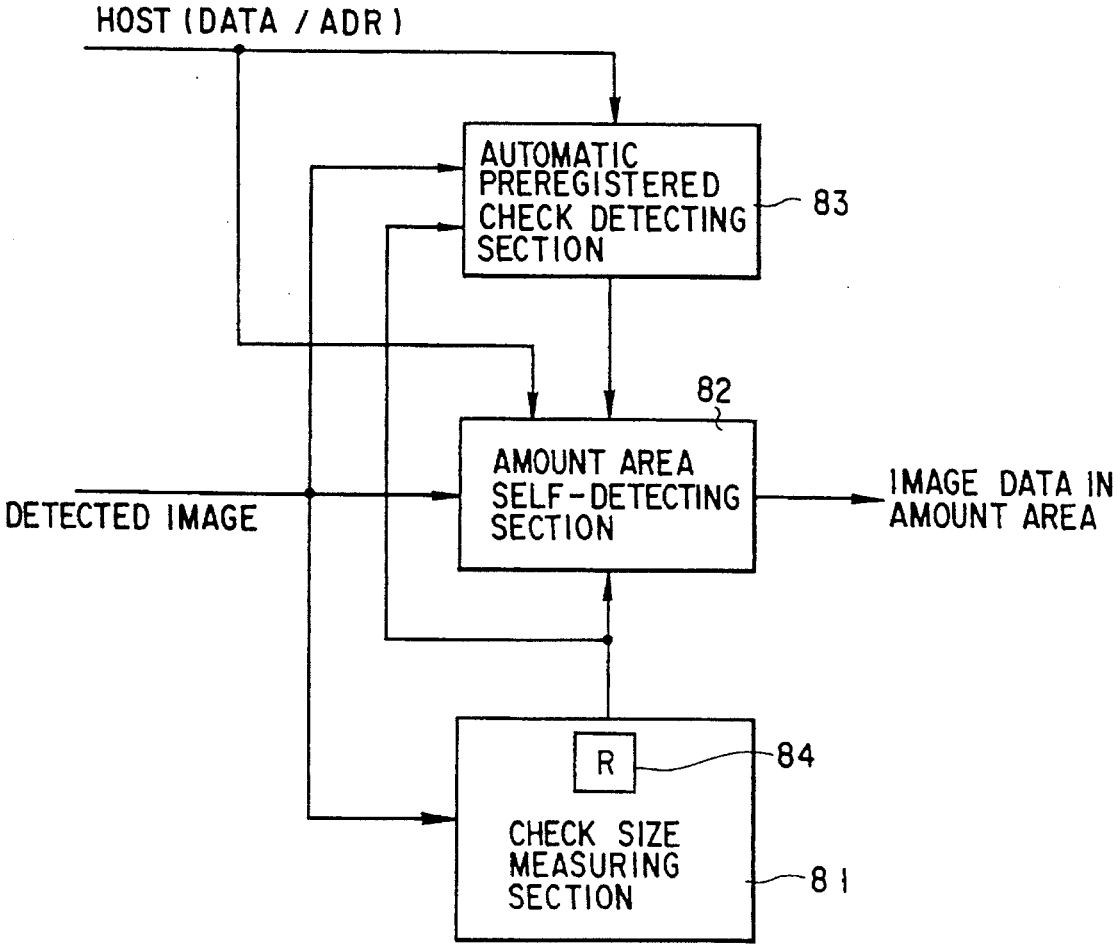
FIG. 18 is a block diagram schematically showing the arrangement of an amount area detecting section according to the second embodiment.

FIG. 18 schematically shows the arrangement of the amount area detecting section 72. The amount area detecting section 72 is constituted by a check size measuring section 81, an amount area self-detecting section 82, and an automatic preregistered check detecting section 83.

The check size measuring section 81 measures the vertical and horizontal lengths of the check Q on the basis of the detected image corresponding to the check Q and supplied from the signal processing section 14. In this case, the vertical length (length in the conveying direction) of the check Q is obtained from passage detection information, e.g., the time taken for the passage of the leading and trailing ends of the check Q, which is detected by a conveyance detector (not shown) arranged on a convey path 3, and the convey speed. The horizontal length (length in a direction perpendicular to the conveying direction) of the check Q is calculated by the ratio of the vertical length to the horizontal length of the detected image.

In this embodiment, the check size measuring section 81 operates in synchronism with the transfer of each detected image. When input of all the detected images of the check Q is completed, the check size measuring section 81 stores the vertical and horizontal lengths (size data) in an internal register (R) 84. This size data is supplied from the check size measuring section 81 to the amount area self-detecting section 82 and the automatic preregistered check detecting section 83, as needed.

The amount area self-detecting section 82 measures the spatial density of a character image obtained by binarization processing of the detected image on the basis of the size data from the check size measuring section 81 and the detected image from the signal processing section 14, and obtains an amount information area on the check Q corresponding to the detected image from the measurement result.

In addition, the amount area self-detecting section 82 outputs image data on the detected image corresponding to the amount information area obtained by itself to the character detecting section 73. Alternatively, image data on the detected image corresponding to coordinate data (to be described later) supplied from the automatic preregistered check detecting section 83 is output to the character detecting section 73 in preference to the above-mentioned image data.

The automatic preregistered check detecting section 83 receives the size data from the check size measuring section 81 and the detected image from the signal processing section 14, and compares them with each preregistered check size and feature information on this preregistered check to detect whether the check Q is the preregistered check.

If the check Q is the preregistered check, coordinate data representing the position of the amount information area on the preregistered check is output to the amount area self-detecting section 82. Thereafter, image data on the partial circuit corresponding to the coordinate data is forcibly output as image data within the amount information area of the check Q. The automatic preregistered check detecting section 83 will be described in detail later.

Note that the amount area self-detecting section 82 and the automatic preregistered check detecting section 83 are operated in accordance with commands from a host computer (HOST) (not shown).

Figure 19:
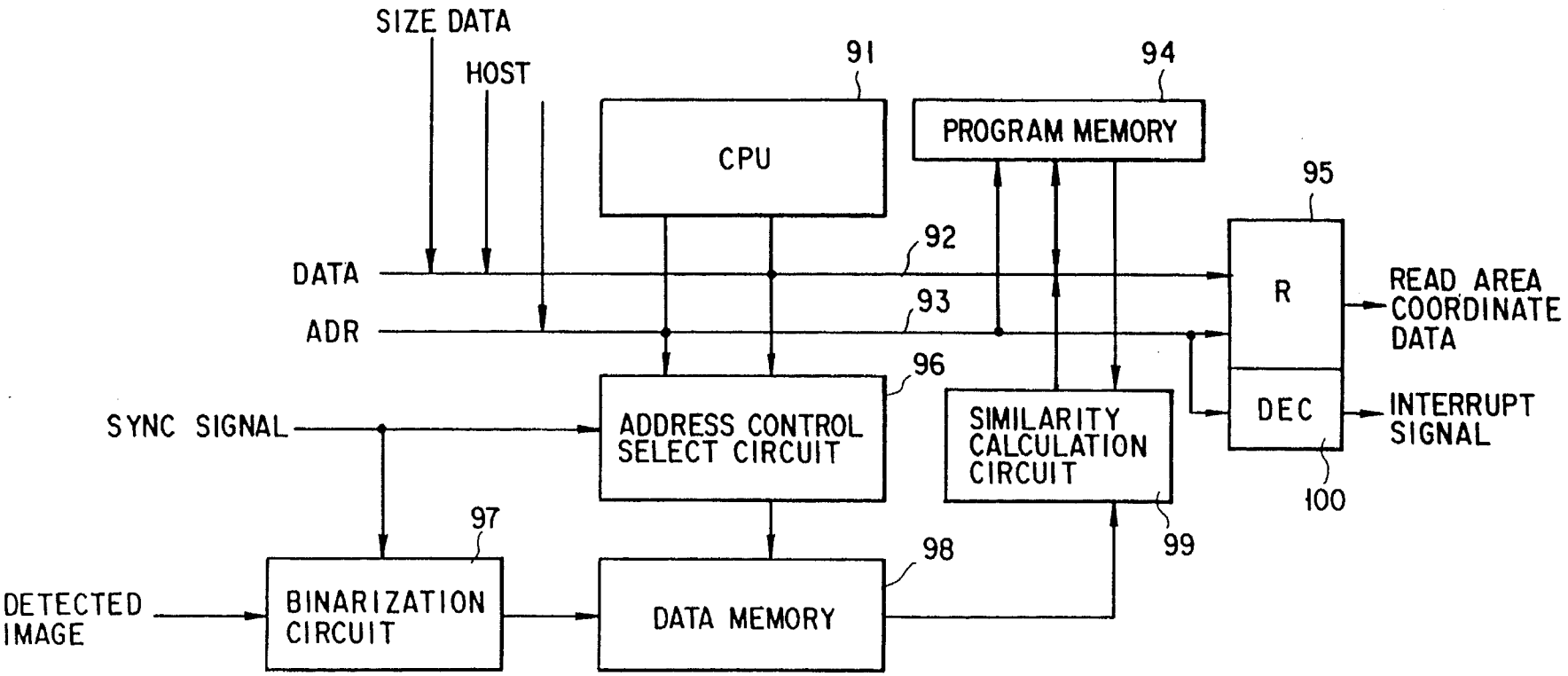
FIG. 19 is a block diagram schematically showing the arrangement of an automatic preregistered check detecting section according to the second embodiment.

FIG. 19 schematically shows the arrangement of the automatic preregistered check detecting section 83. The automatic preregistered check detecting section 83 comprises a CPU 91 for performing overall control, and a program memory 94, a register (R) 95, and an address control select circuit 96 which are connected to the CPU 91 through a data bus (DATA) 92 and an address bus (ADR) 93. In addition, the automatic preregistered check detecting section 83 comprises a binarization circuit 97, a data memory 98, and a similarity calculation circuit 99.

The check size measuring section 81 is connected to the data bus 92 to receive size data therefrom. A host computer (HOST) (not shown) is connected to the data bus 92 and the address bus 93.

The binarization circuit 97 receives a detected multi-value image from the signal processing section 14 together with the corresponding sync signal (a horizontal sync signal and an image sync signal for each line scanning), and converts the image into a binary image signal of (1, 0).

The data memory 98 receives and stores the binary image signal processed by the binarization circuit 97 in accordance with the above-mentioned sync signal.

The similarity calculation circuit 99 receives the binary image signal stored in the data memory 98 under the control of the address control select circuit 96, calculates a similarity between the input image and the feature image of the check preregistered in the program memory 94 in advance, and outputs the similarity value obtained by this calculation onto the data bus 92.

The address control select circuit 96 receives the output from the binarization circuit 97 in accordance with the above-mentioned sync signal, and also controls a write or read operation with respect to the data memory 98 in accordance with commands from the CPU 91 which are supplied through the data bus 92 and the address bus 93.

The register 95 stores coordinate data representing the position of the amount information area of each preregistered check which is to be output to the amount area self-detecting section 82, and has a decoder (DEC) 100 for generating an interrupt signal for performing an interruption to output the coordinate data. The program memory 94 stores program data and the like for causing the CPU 91 to perform a sequential operation. Although this program memory 94 is designed to allow data from the host computer to be written through the data bus 92, the memory can also be realized by a ROM in which data are written in advance.

The CPU 91 operates in accordance with the contents of the program memory 94 to control the address control select circuit 96. In addition, on the basis of image data read out from an arbitrary position in the data memory 98, the CPU 91 detects whether given check is the above-mentioned preregistered check. If the given check is the preregistered check, the CPU 91 stores coordinate data representing the position of the amount information area in the register 95.

The identification determination for detecting whether the check Q, from which an image has already been detected, is a preregistered check will be described below.

Figure 20:
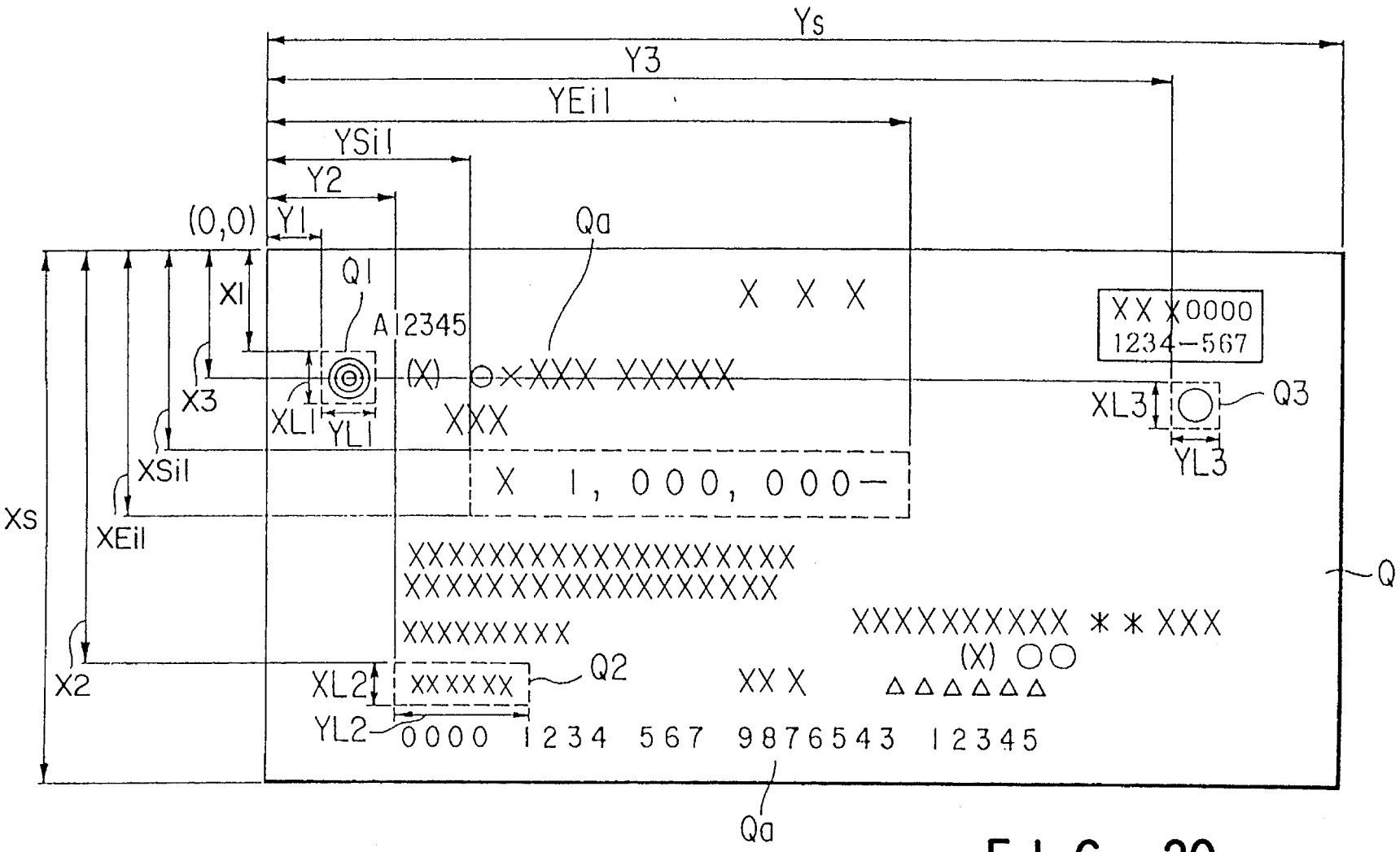
FIG. 20 is a view showing a check to be preregistered as a preregistered check according to the second embodiment.

FIG. 20 shows an example of the check Q to be preregistered as a preregistered check. In this case, in addition to information Qa of character and codes indicating the name and location of a bank and a check number, pieces of inherent feature information Q1, Q2, and Q3 on the check, such as a logo of the bank are pre-printed on the check Q.

Figure 21:
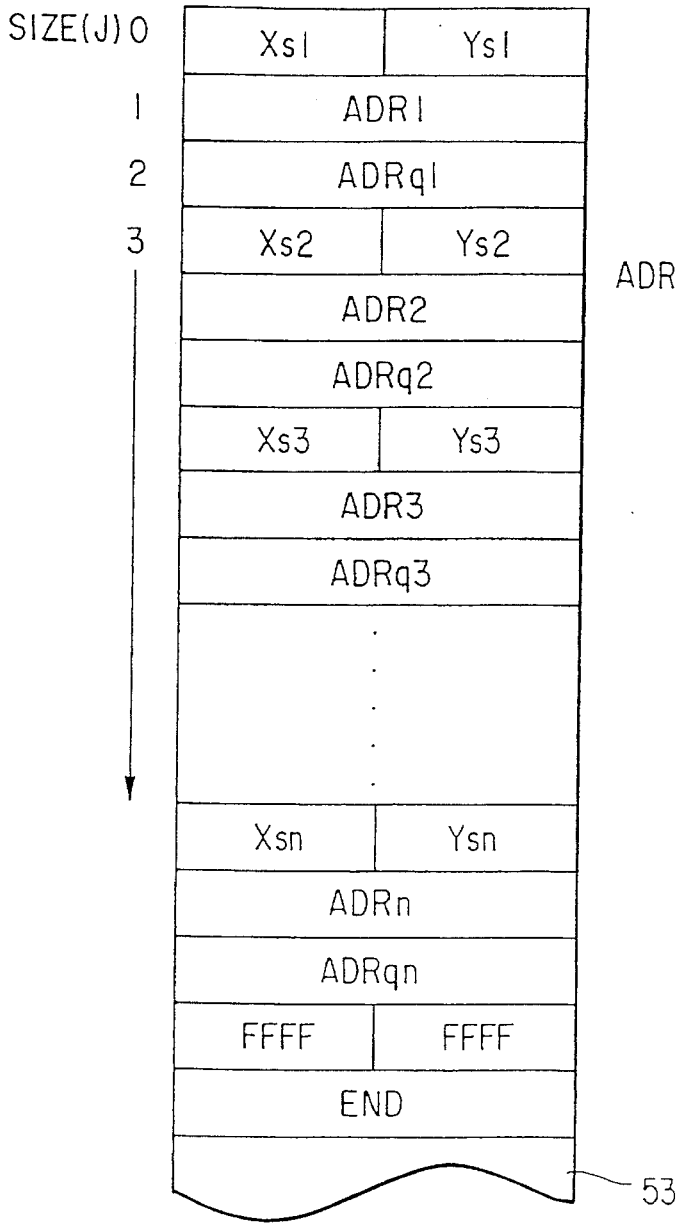
FIG. 21 is a chart showing an example of the arrangement of a size management table according to the second embodiment.
Figure 22:
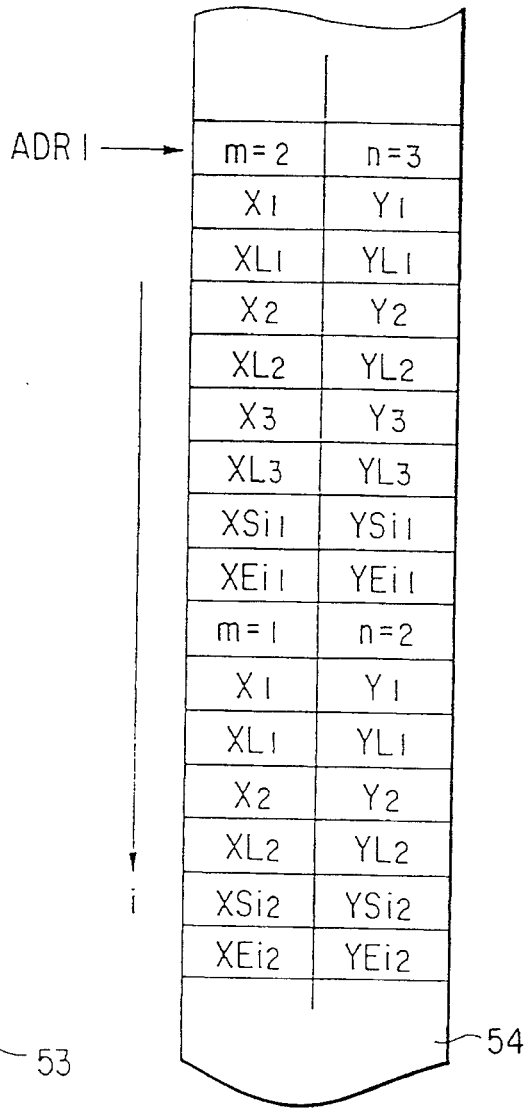
FIG. 22 is a chart showing an example of the arrangement of a feature management table according to the second embodiment.
Figure 23:
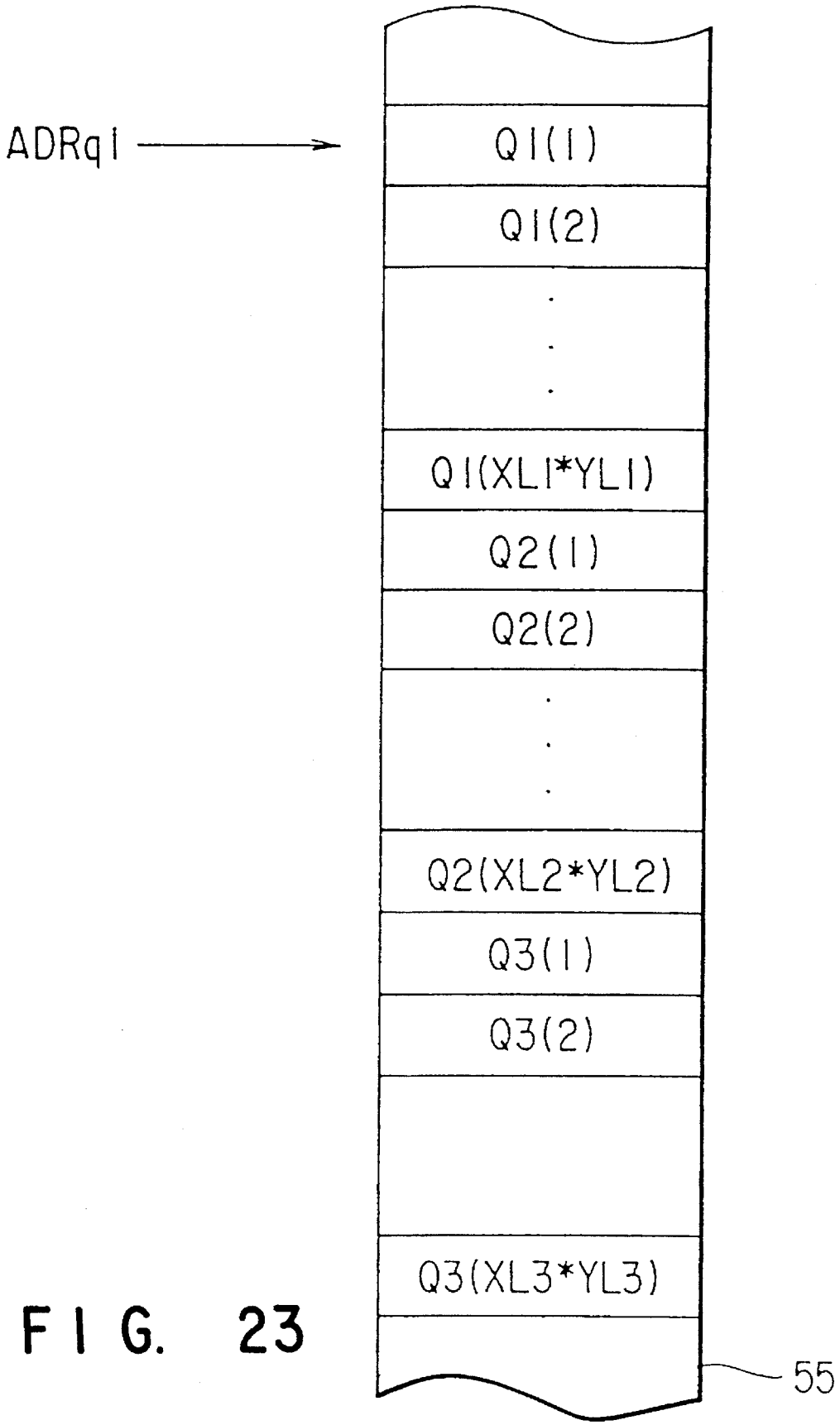
FIG. 23 is a chart showing an example of the arrangement of a feature pattern management table according to the second embodiment.

FIGS. 21 to 23 show management tables for managing the contents of preregistered checks. For example, a size management table 53, a feature management table 54, and a feature pattern management table 55 are stored in the program memory 94. The size management table 53 has an address termed "SIZE" as a start address. The feature management table 54 has an address termed "ADR" as a start address. The feature pattern management table 55 has an address termed "ADRq" as a start address.

Figure 12:
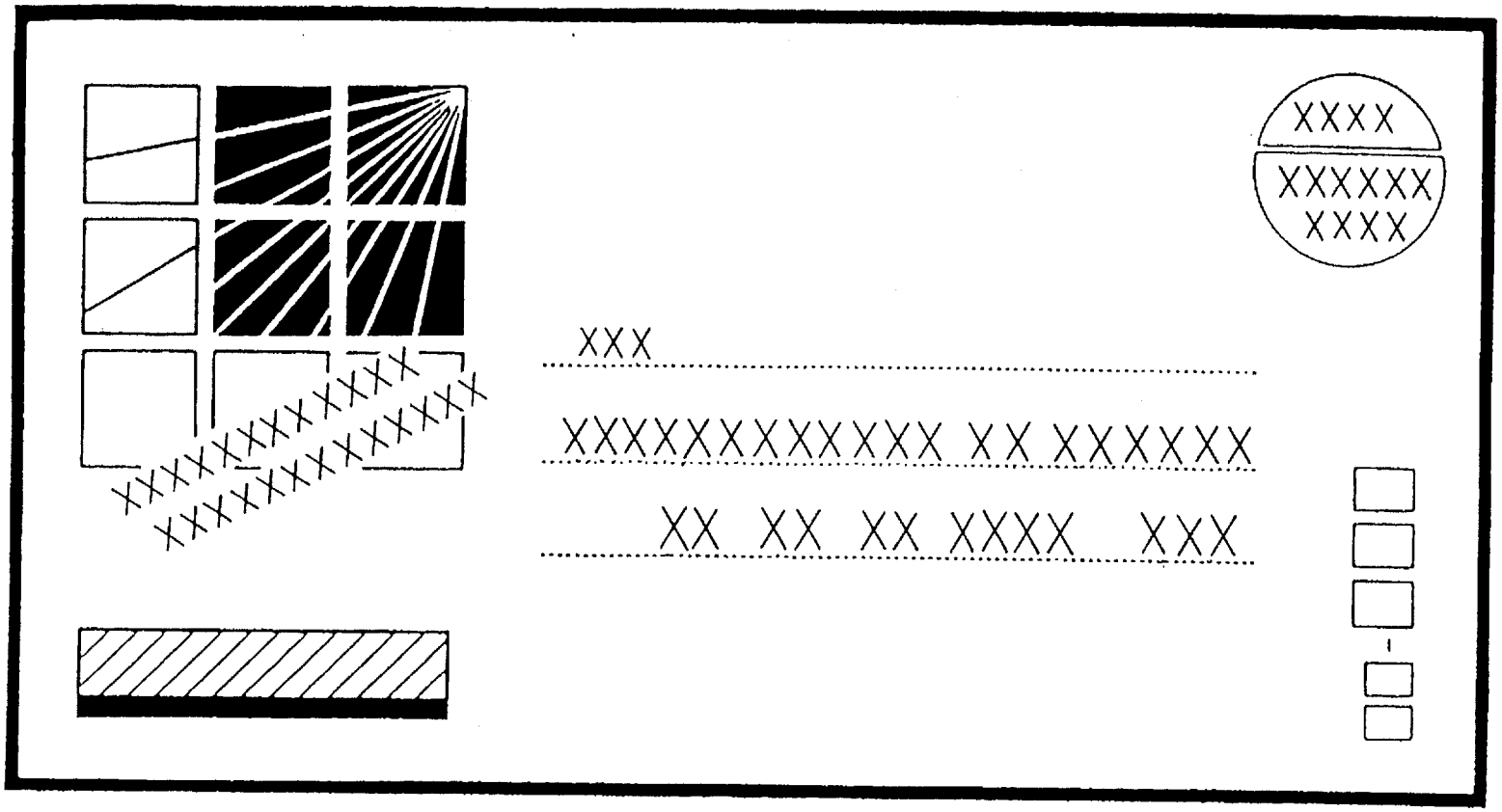
FIG. 12 is a view showing the manner of handling a mail image in address area self-detection processing according to the first embodiment.
Figure 14:
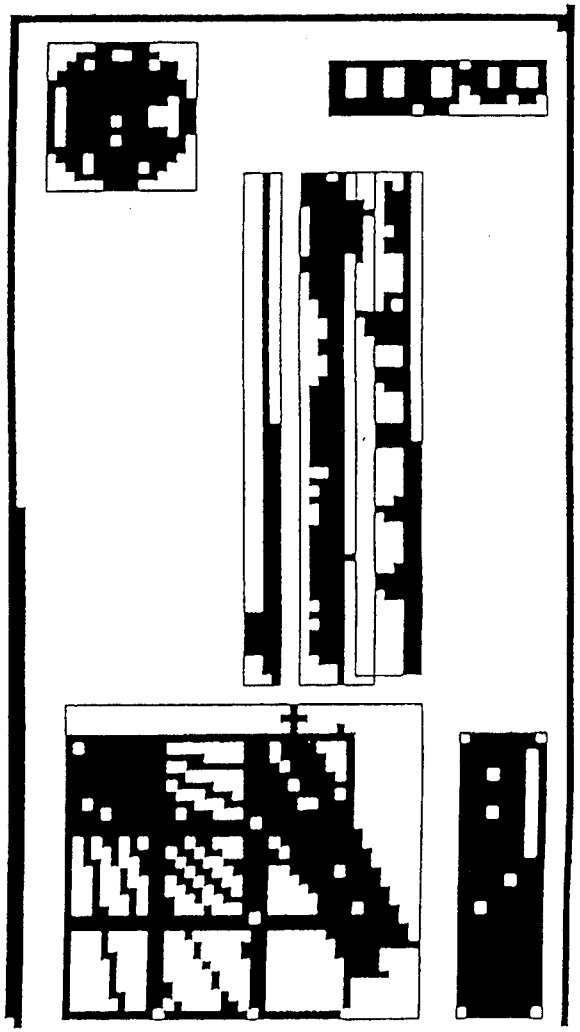
FIG. 14 is a view showing the manner of handling a mail image in address area self-detection processing according to the first embodiment.
Figure 13:
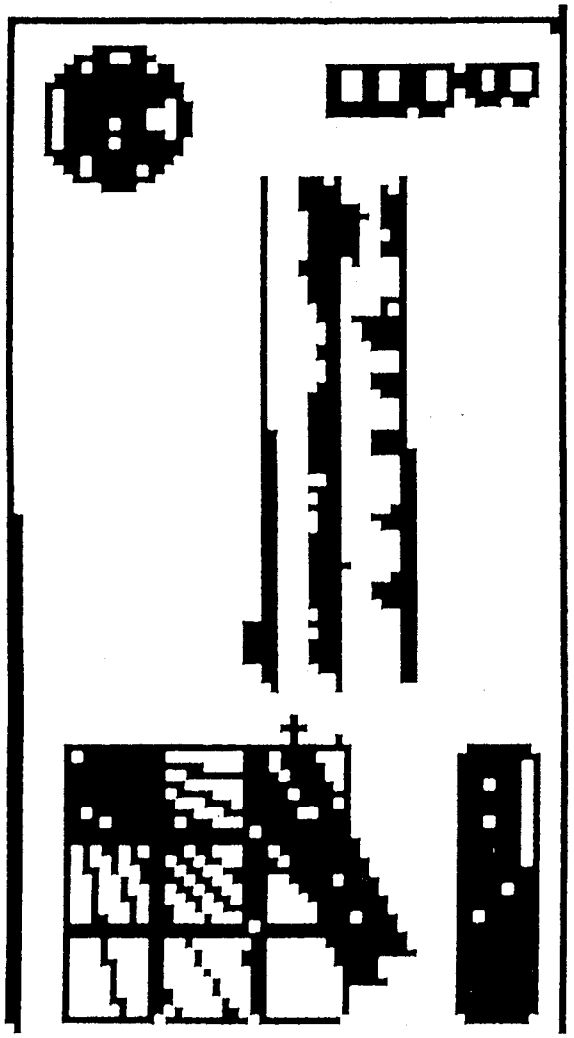
FIG. 13 is a view showing the manner of handling a mail image in address area self-detection processing according to the first embodiment.
Figure 15:
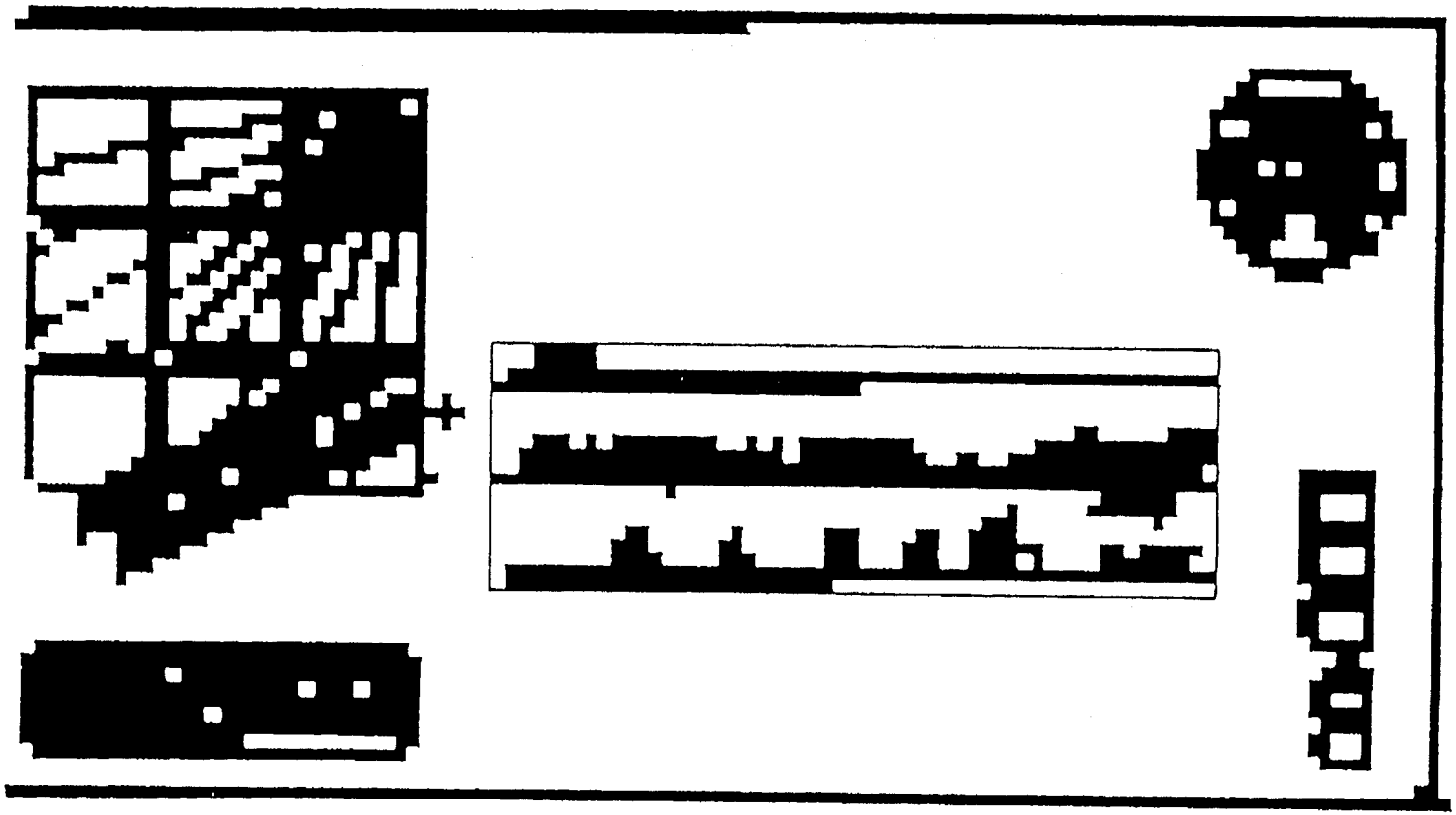
FIG. 15 is a view showing the manner of handling a mail image in address area self-detection processing according to the first embodiment.

For example, as shown in FIG. 12, in the size management table 53, sizes (Xsn, Ysn) of checks preregistered as preregistered checks, start addresses (ADRn) of the feature management table 54 for managing feature information as a fixed, pre-printed image on each check, and start addresses (ADRqn) of the feature pattern management table 55 for managing each feature information pattern.

As a preregistered check having the same size as that of the check Q whose image has been detected, a check having a size defined by "Xs1, Ys1" is preregistered. The feature information of this preregistered check is stored at an address position defined by "ADR1" in the feature management table 54, and the feature information pattern of the check is stored at an address position defined by "ADRq1".

As shown in FIG. 22, for example, the feature management table 54 serves to store positions (Xn, Yn) and sizes (XLn, YLn) of pieces of feature information on each preregistered check, feature information patterns (Qn(i)): i=1 to XLn x YLn), and coordinate data {(xSin, YSin), (XEin, YEin)} indicating the position of the amount information area of each preregistered check, together with a number (m) of types of preregistered checks and a number (n) of pieces of feature information corresponding to the respective preregistered checks.

Assume that access is made with respect to an address (ADR1). In this case, for example, there are two types of preregistered checks having the same size as that of the check Q, and the first type of preregistered check has three pieces of feature information Q1, Q2, and Q3. In addition, positions (X1, Y1), (X2, Y2), and (X3, Y3) of the pieces of feature information Q1, Q2, and Q3 with respect to a reference point (0, 0), and their sizes (XL1, YL1), (XL2, YL2), and (XL3, YL3) can be known. Furthermore, coordinate data {((XSi1, YSi1), (XEi1, YEi1)} indicating a position {(XS, YS), (XE, YE)} of the amount information area of the preregistered check can be known.

Similarly, that the second type of preregistered check has two pieces of feature information Q1 and Q2, and their positions (X1, Y1) and (X2, Y2) with respect to a reference point (0, 0) can be known. In addition, sizes (XL1, YL1) and (XL2, YL2) of the pieces of feature information, and coordinate data {(XSi2, YSi2), (XEi2, YEi2)} indicating a position {(XS, YS), (XE, YE)} of the address information area of the preregistered check can be known.

Assume that access is made with respect to an address (ADRq1). In this case, with regard to a preregistered check having the same size as that of the check Q, a feature pattern (Q1(i):=1 to XL1×YL1), (Q2(i): 1=XL2×YL2), (Q3(i): i=1 to XL3×YL3) of pieces of feature information Q1, Q2, and Q3 of the first type of preregistered check, and a feature pattern (Q1(i): i=1 to XL1×YL1), (Q2(i): i=1 to XL2×YL2) of the second type of preregistered check can be known.

Figure 24:
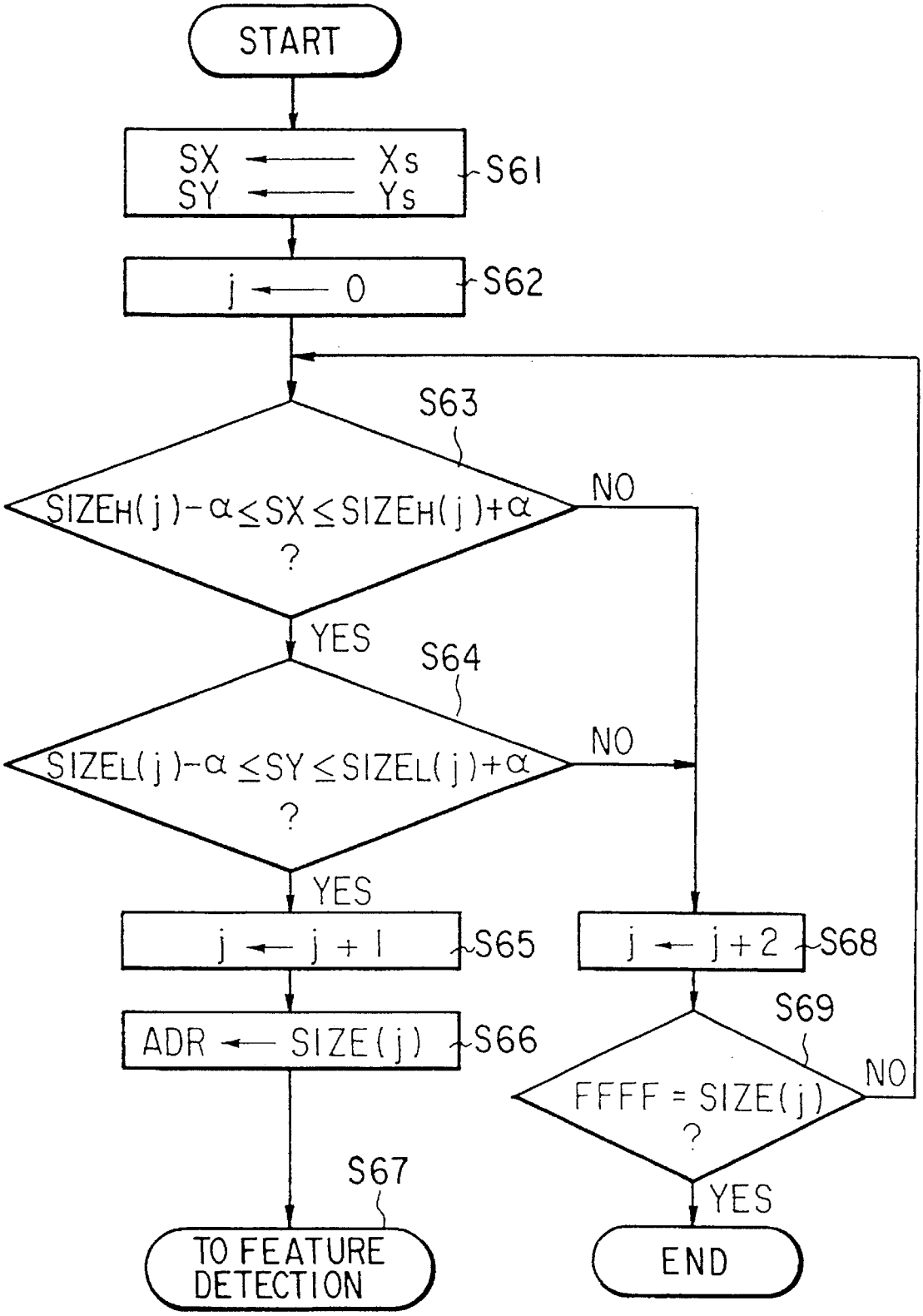
FIG. 24 is a flow chart for explaining the flow of processing associated with detection of a preregistered check according to the second embodiment.

FIG. 24 shows the flow of processing associated with detection of a preregistered check. Assume that the size of the check Q whose image has been detected is measured by the check size measuring section 81, and size data (Xs, Ys) as the measurement value is supplied to the automatic preregistered check detecting section 83.

The size data (Xs, Ys) is then input to the CPU 91 through the data bus 92 and is stored in internal registers SX and SY (step S61). Thereafter, respective data in the size management table 53 stored in the program memory 94 are sequentially retrieved in accordance with the contents of the registers SX and SY to check a coincidence (steps S62, S63, and S64).

In this case, the identity of the size data (Xs, Ys) stored in the registers SX and SY is determined with respect to the size (Xsn, Ysn) of each check preregistered in the size management table 53 within a certain range of errors (±a). That is, it is detected whether any check having substantially the same size as that of the check Q whose image has been detected is present as a preregistered check.

This determination of identity is performed with respect to all the sizes (Xsn, Ysn) in the table 53. Every time a coincidence is determined, access is made with respect to the corresponding address (ADRn) in the feature management table 54 and the corresponding address (ADRqn) in the feature pattern management table 55 (steps S65, S66, and S67).

If, for example, it is determined that the size data coincides with the size (Xs1, Ys1) in the size management table 53 shown in FIG. 21, access is made with respect to the corresponding address (ADR1) in the feature management table 54 and the corresponding address (ADRq1) in the feature pattern management table 55.

Note that if no coincidence is determined up to the end of the data of the size management table 53, it is determined that the check Q is not a preregistered check. In this case, the processing is completed, and a wait state is kept until the image of the next check Q is detected (steps S68 and S69)

Figure 25:
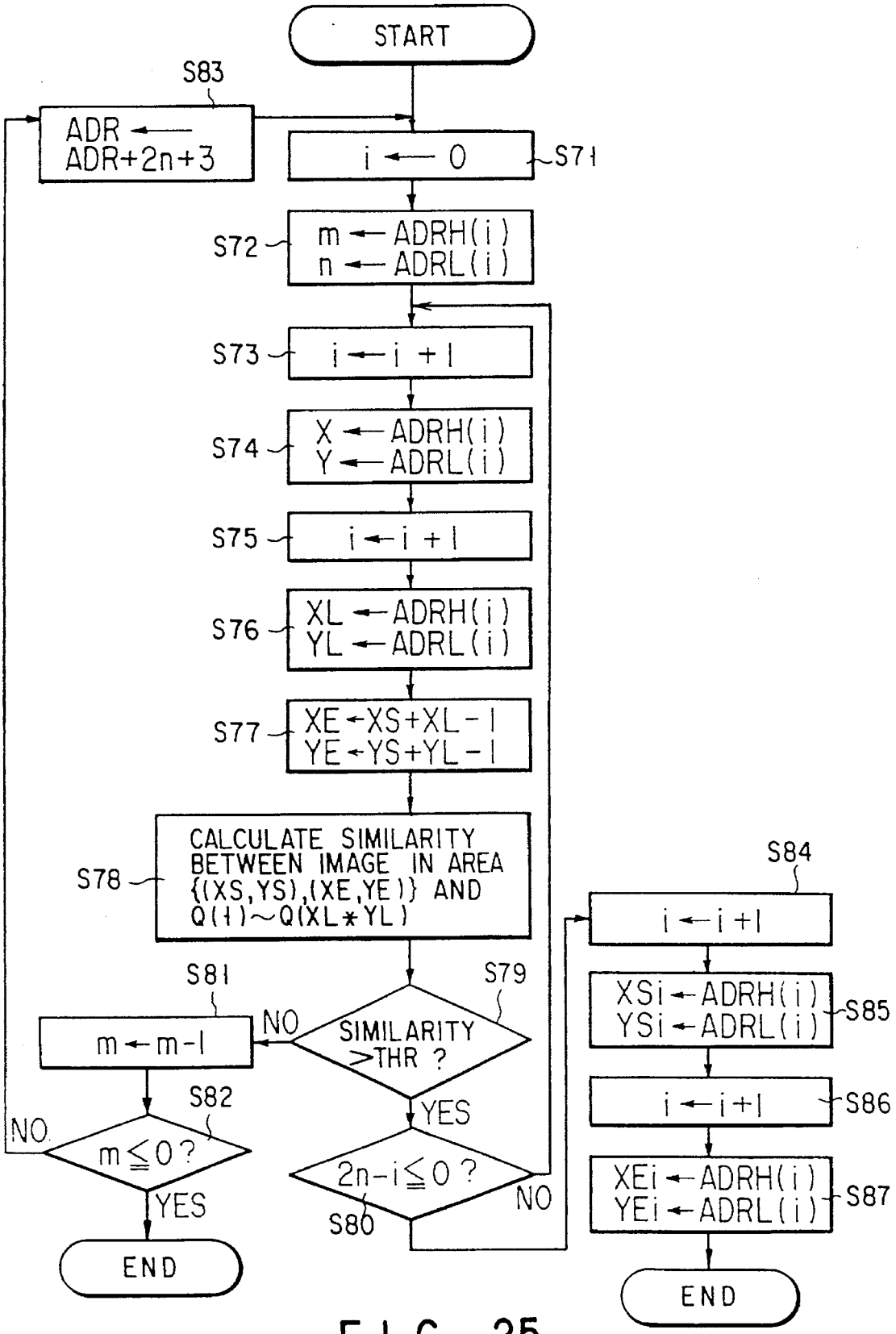
FIG. 25 is a flow chart for explaining the flow of processing associated with detection of features of a check according to the second embodiment.

FIG. 25 shows the flow of processing associated with detection of the features of the check Q. When it is detected by the above-described detection processing of a preregistered check that there is a preregistered check having the same size as that of the check Q, it is checked by referring to the feature management table 54 shown in FIG. 22 and the feature pattern management table 55 shown in FIG. 23 whether all pieces of preregistered feature information coincide with those of the check Q (steps S71 to S80).

Assume that it is detected by the above-described determination of identity that there is a preregistered check having the same size as that of the check Q. In this case, the image data stored in the data memory 98 are read out by the CPU 91 through the address control select circuit 96. Thus, coincidence is determined by performing pattern matching between a feature information pattern, in the feature pattern management table 55, which corresponds to the address (ADRqn), and image data of an area indicated by the data of the position (Xn, Yn) and the size (XLn, YLn), in the feature management table 54, which correspond to the address (ADRn) of the size for which identity is determined.

Assume that access is made with respect to address ADR1 in the feature management table 54 shown in FIG. 22 and address ADRq1 of the feature pattern management table 55. In this case, it is checked, by pattern matching, whether the image data, on the check Q, indicated by the positions (X1, Y1), (X2, Y2), (X3, Y3) and the sizes (XL1, YL1), (XL2, YL2), and (XL3, YL3) coincide with the three pieces of feature information Q1, Q2, and Q3 of the first type of preregistered check (steps S71 to S80).

If, for example, it is determined that all the pieces of feature information coincide with the corresponding pieces of information, the coordinate data {XSi1, YSi1), (XEi1, YEi1)} indicating the position of the amount information area of this preregistered check is output to the amount area self-detecting section 82 through the register 95, by an interrupt operation, as the coordinate data {XS, YS), (XE, YE)} indicating the position of the amount information area of the check Q (steps S84 to S87). The processing in this case is then completed.

If at least one of the three pieces of feature information Q1, Q2, and Q3 corresponding to the first 10 type of preregistered check does not coincide with the corresponding information, it is checked whether the pieces of feature information on the check Q coincide with the two pieces of feature information Q1 and Q2 corresponding to the second type of preregistered check, which follows the first type of preregistered check.

If it is determined that the two pieces of feature information coincide with the corresponding pieces of information, the coordinate data {(XSi2, YSi2), (XEi2, YEi2)} indicating the position of the amount information area of this preregistered check is output as the coordinate data {(XS, YS), (XE, YE)} indicating the position of the address information area of the check Q. The processing in this case is then completed (steps S84 to S87).

If at least one of the two pieces of feature information does not coincide with the corresponding information, it is determined that the check Q is not a preregistered check. That is, processing of "m←m−1" is performed to set "m=0", and the processing in this case is then completed (steps S81 and S82). A wait state is kept until the image of the next check Q is detected (step S83).

As described above, according to the second embodiment, similar to the case of mail in the first embodiment, the amount information area (read area) of each check can be efficiently and accurately detected. In addition, since determination of coincidence is performed with respect to pieces of feature information by pattern matching processing, more accurate detection can be performed.

The third embodiment of the present invention will be described next.

The third embodiment is designed to reliably obtain the same objects and effects as those of the second embodiment described above by using color images in the second embodiment. Since the third embodiment has almost the same arrangement as that of the second embodiment except for an automatic preregistered check detecting section 83, only the automatic preregistered check detecting section 83 will be described in detail below. The same reference numerals in the third embodiment denote the same parts as in the second embodiment, and a detailed description thereof will be omitted, and only different portions will be described in detail.

Figure 26:
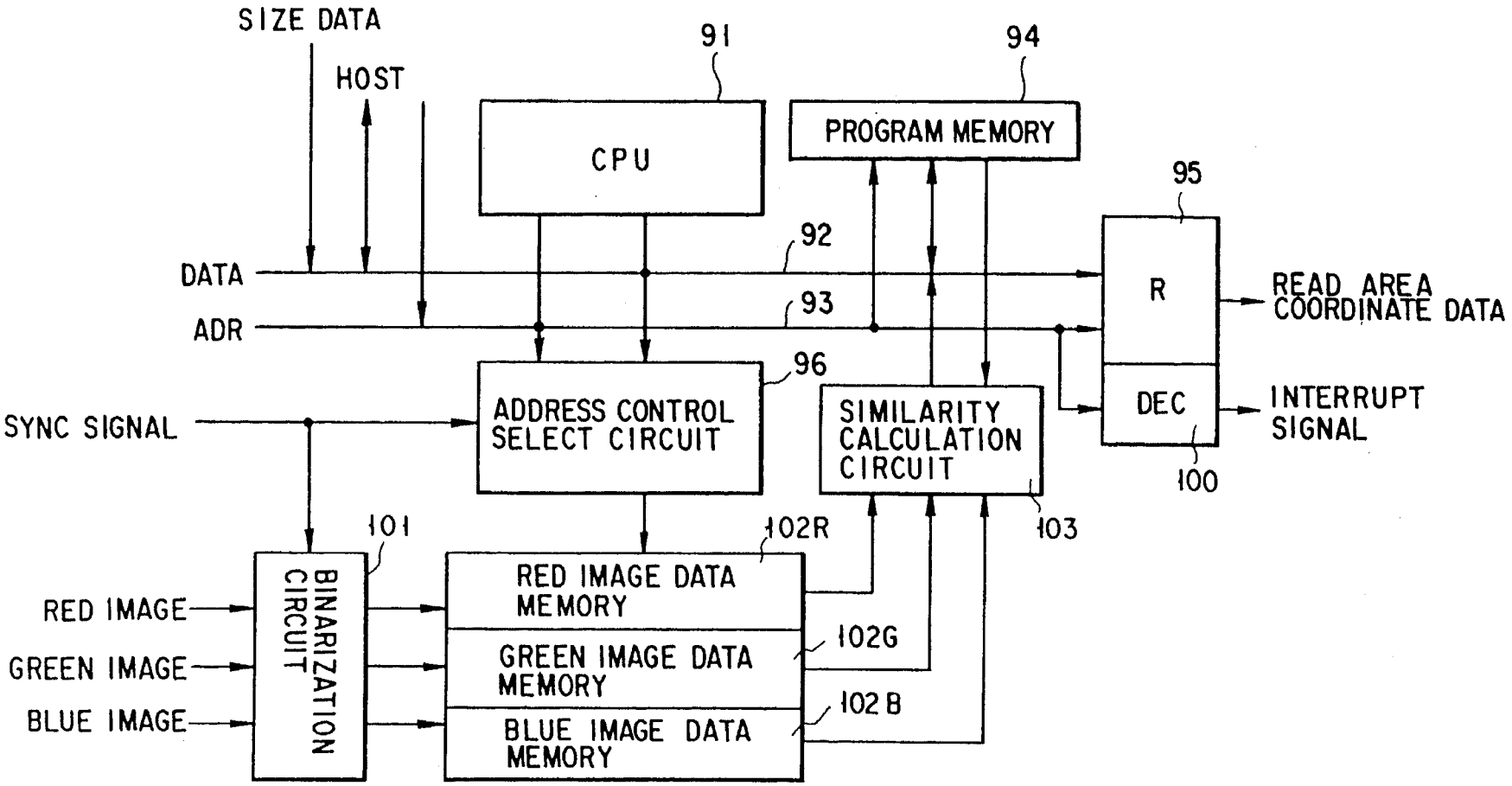
FIG. 26 is a block diagram schematically showing the arrangement of an automatic preregistered check detecting section of an amount area detecting section in a reading section according to the third embodiment of the present invention.

FIG. 26 schematically shows the arrangement of the automatic preregistered check detecting section 83. The automatic preregistered check detecting section 83 comprises a CPU 91 for performing overall control, and a program memory 94, a register (R) 95, and an address control select circuit 96 which are connected to the CPU 91 through a data bus (DATA) 92 and an address bus (ADR) 93. In addition, the automatic preregistered check detecting section 83 comprises a binarization circuit 101, a red image data memory 102R, a green image data memory 102G, a blue image data memory 102B, and a similarity calculating circuit 103.

The binarization circuit 101 receives red, green, and blue detected images from a signal processing section 14, together with a sync signal (a horizontal sync signal and an image sync signal for each line scanning), and converts the images into binary image signals of (1, 0).

The red image data memory 102R receives and stores a binary red image signal processed by the binarization circuit 101 in accordance with the above-mentioned sync signal.

The green image data memory 102G receives and stores a binary green image signal processed by the binarization circuit 101 in accordance with the sync signal.

The blue image data memory 102B receives and stores a binary blue image signal processed by the binarization circuit 101 in accordance with the sync signal.

The similarity calculating circuit 103 receives the binary image signals, respectively stored in the red image data memory 102R, the green image data memory 102G, and the blue image data memory 102B, under the control of the address control select circuit 96, and calculates similarities between the signals and feature images of each check preregistered in the program memory 94. The similarity calculating circuit 103 outputs the similarity value obtained by this calculation onto the data bus 92.

Note that the address control select circuit 96, the register 95, the program memory 94, the CPU 91, and the data memory 100 perform the same operations as those in the second embodiment described above (FIG. 19).

Although not described above, it is apparent that an image detecting means constituted by an optical system 12, a line sensor 13, and a signal processing section 14 in the third embodiment can process a color image on a check Q upon separating the image into R (red), G (green), and B (blue) data.

FIGS. 27 to 31 show management tables for managing the contents of each preregistered check. For example, a size management table 56, a feature management table 57, a red feature pattern management table 58R, a green feature pattern management table 58G, and blue feature pattern management table 58B are stored in the program memory 94. The size management table 56 has an address termed "SIZE" as a start address. The feature management table 57 has an address termed as "ADR" as a start address. The red feature pattern management table 58R has an address termed as "ADRr" as a start address. The green feature pattern management table 58G has an address termed as "ADRg" as a start address. The blue feature pattern management table 58B has an address termed as "ADRb" as a start address.

Figure 27:
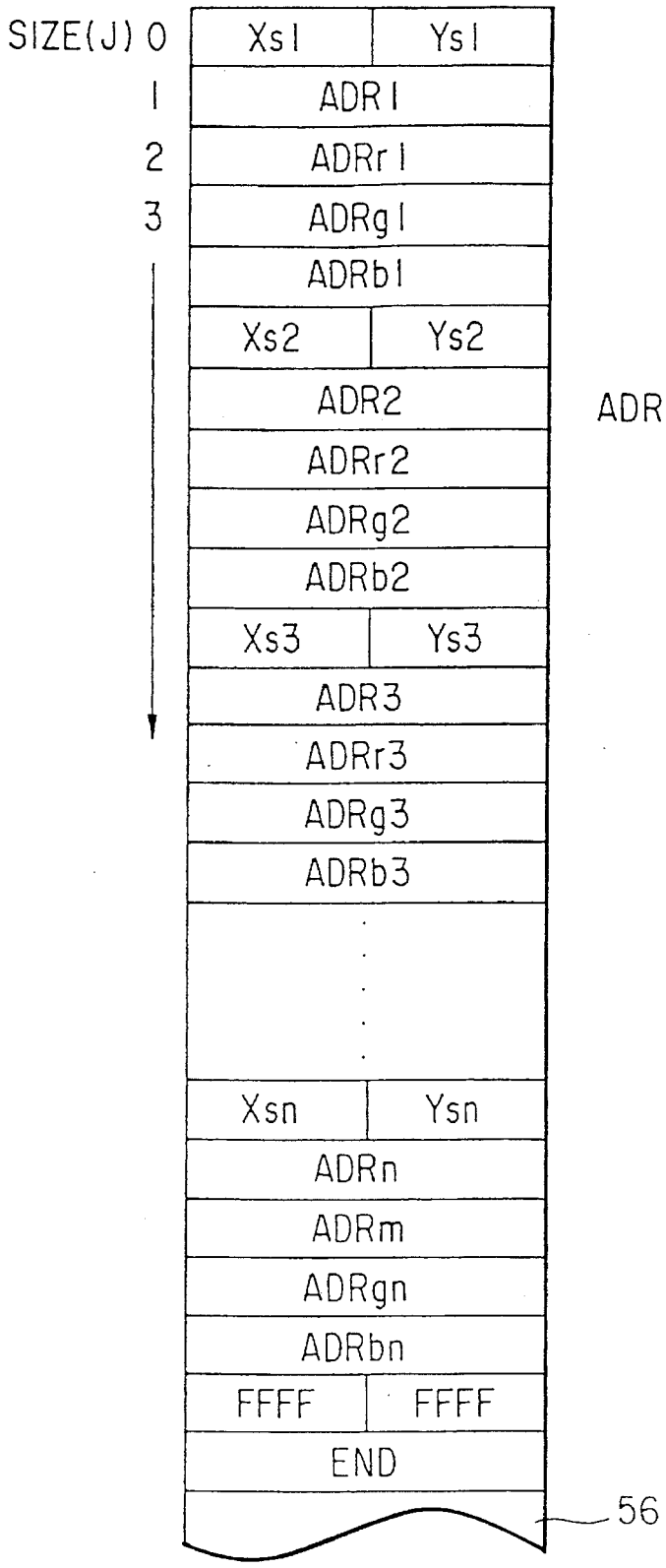
FIG. 27 is a chart showing an example of the arrangement of a size management table according to the third embodiment.

For example, as shown in FIG. 27, in the size management table 56, sizes (Xsn, Ysn) of checks preregistered as preregistered checks, start addresses (ADRn) in the feature management table 57 for managing the positions and the like of pieces of feature information as fixed, pre-printed images on the respective checks, start addresses (ADRrn), (ADRgn), and (ADRbn) in the red, green, and blue feature pattern management tables 58R, 58G, and 58B for managing patterns of three colors of the respective pieces of feature information are paired.

As a preregistered check having the same size as that of the check Q whose image has been detected, for example, a check having a size defined by "Xs1, Ys1" is preregistered, and the feature information of this preregistered check is stored at an address position defined by "ADR1" in the feature management table 57. In addition, a red feature information pattern is stored at an address position defined by "ADRr1" in the red feature pattern management table 58R; a green feature information pattern, at an address position defined by "ADRg1" in the green feature pattern management table 58G; and a blue feature information pattern, at an address position defined by "ADRb1" in the blue feature pattern management table 58B.

Note that the feature management table 57 performs the same operation as that in the second embodiment described above (FIG. 19).

Figure 32:
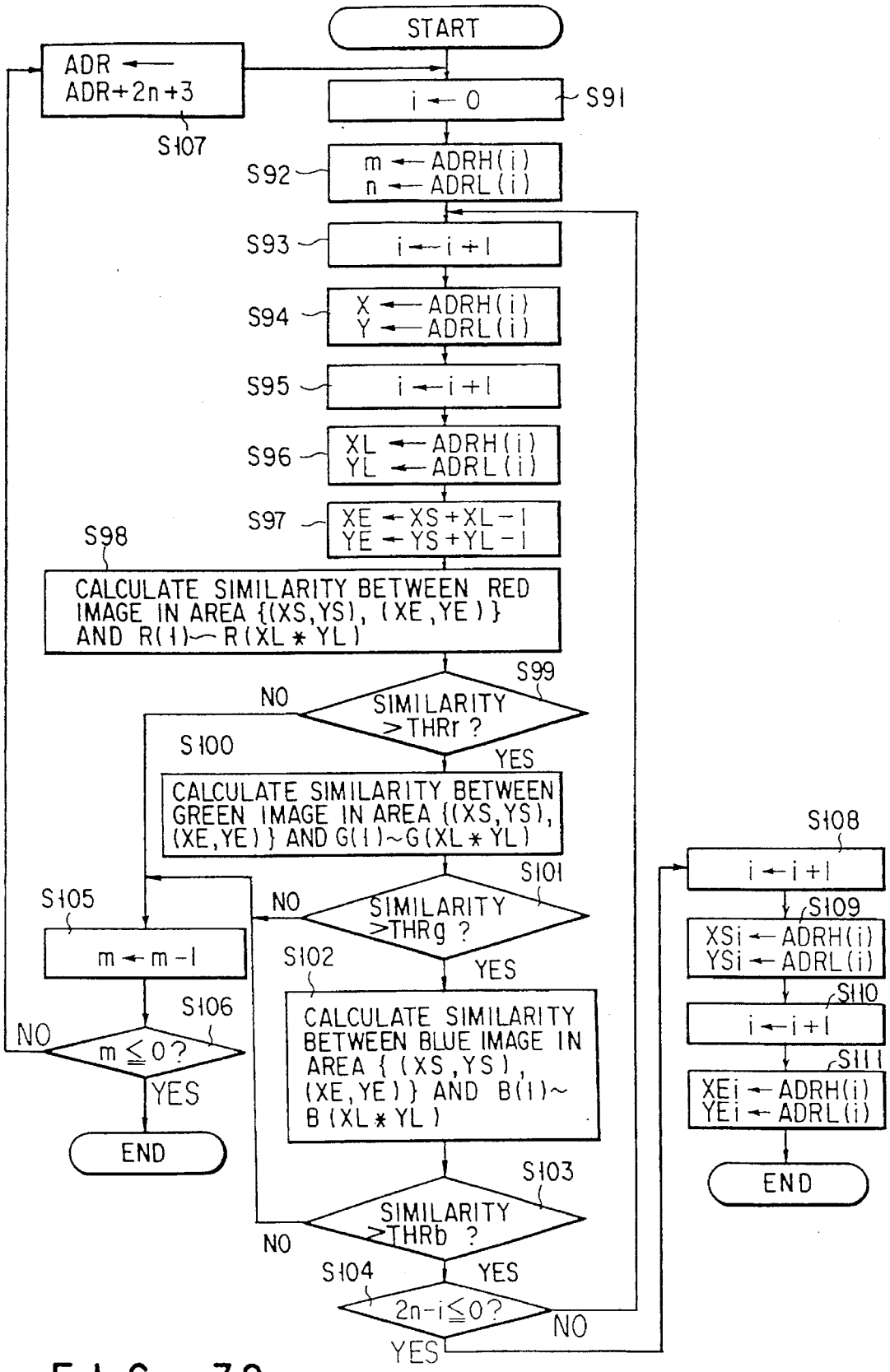
FIG. 32 is a flow chart for explaining the flow of processing associated with detection of features of a check according to the third embodiment.

FIG. 32 shows the flow of processing associated with detection of features of the check Q. When it is detected, by the above-described detection processing of the preregistered checks, that there is a preregistered check having the same size as that of the check Q, it is checked whether all the preregistered feature information coincides with the corresponding information, by referring to the feature management table 57 shown in FIG. 28 and the three types of feature pattern management tables 58R, 58G, and 58B respectively shown in FIGS. 29 to 31.

If, for example, it is detected by the above-described determination of identity that there is a preregistered check having the same size as that of the check Q, the image data stored in three types of data memories 102R, 102G, and 102B are read out by the CPU 91 through the address control select circuit 96 (steps S91 to S97).

Subsequently, coincidence is determined by performing pattern matching between the feature information patterns of the three colors, from the three types of feature pattern management tables 58R, 58G, and 58B, which correspond to addresses (ADRrn), (ADRgn), and (ADRbn) and three types of image data in an area indicated by the data of the position (Xn, Yn) and the size (XLn, YLn), in the feature management table 57, which correspond to the address (ADRn) of the size for which identity is determined (steps S99 to S103).

Figure 28:
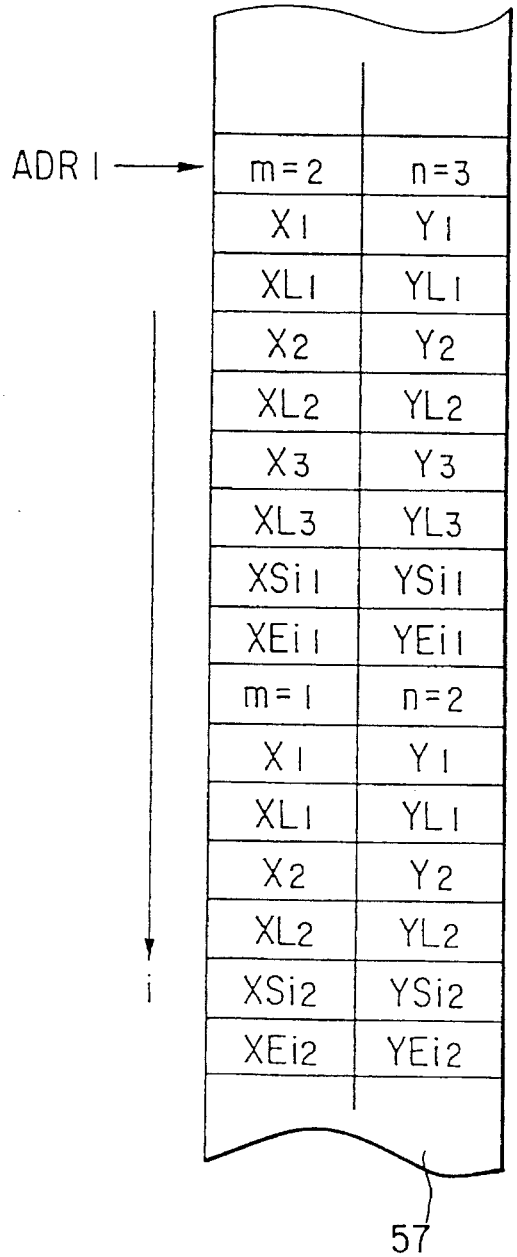
FIG. 28 is a chart showing an example of the arrangement of a feature management table according to the third embodiment.
Figure 29:
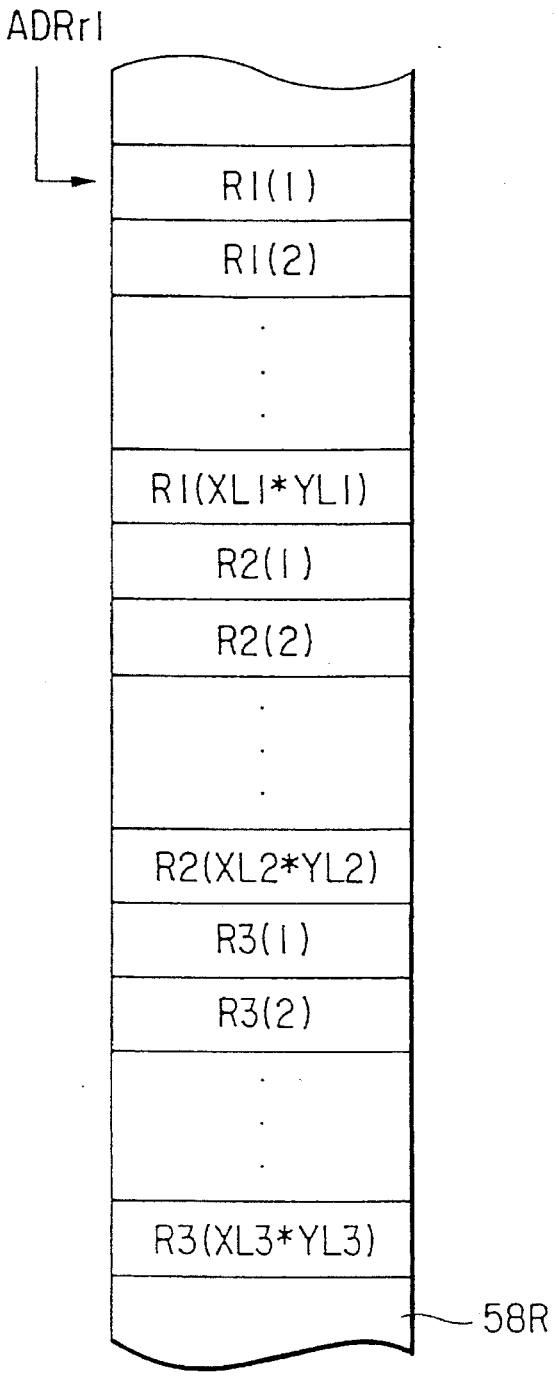
FIG. 29 is a chart showing an example of the arrangement of a red feature pattern management table according to the third embodiment.
Figure 30:
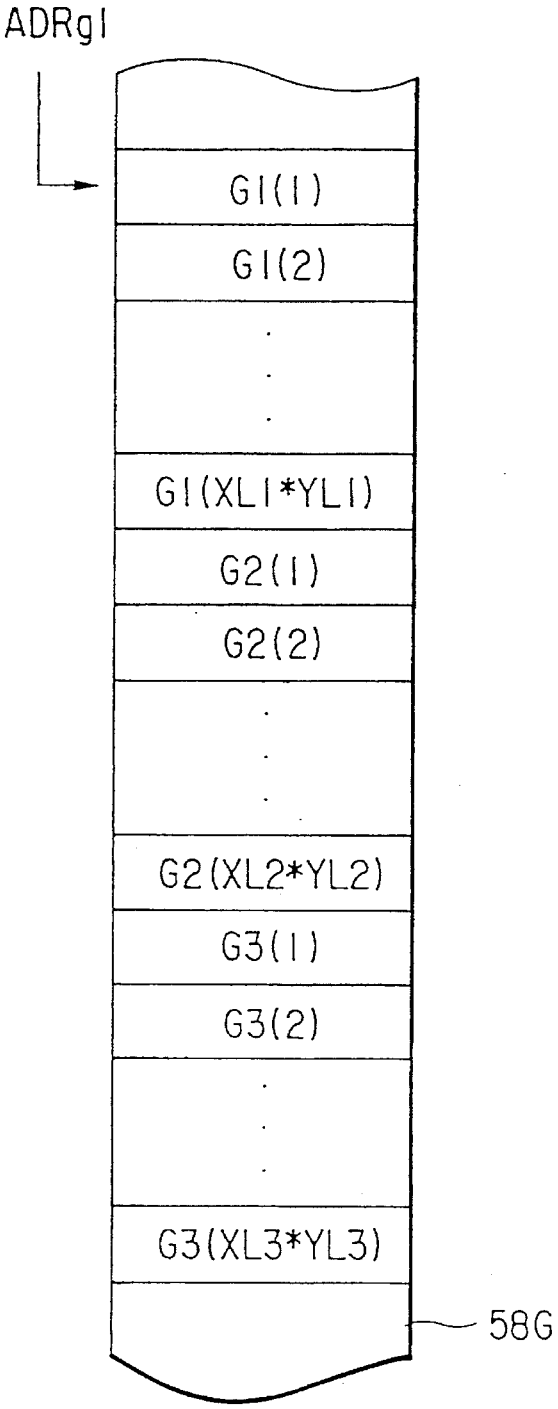
FIG. 30 is a chart showing an example of the arrangement of a green feature pattern management table according to the third embodiment.
Figure 31:
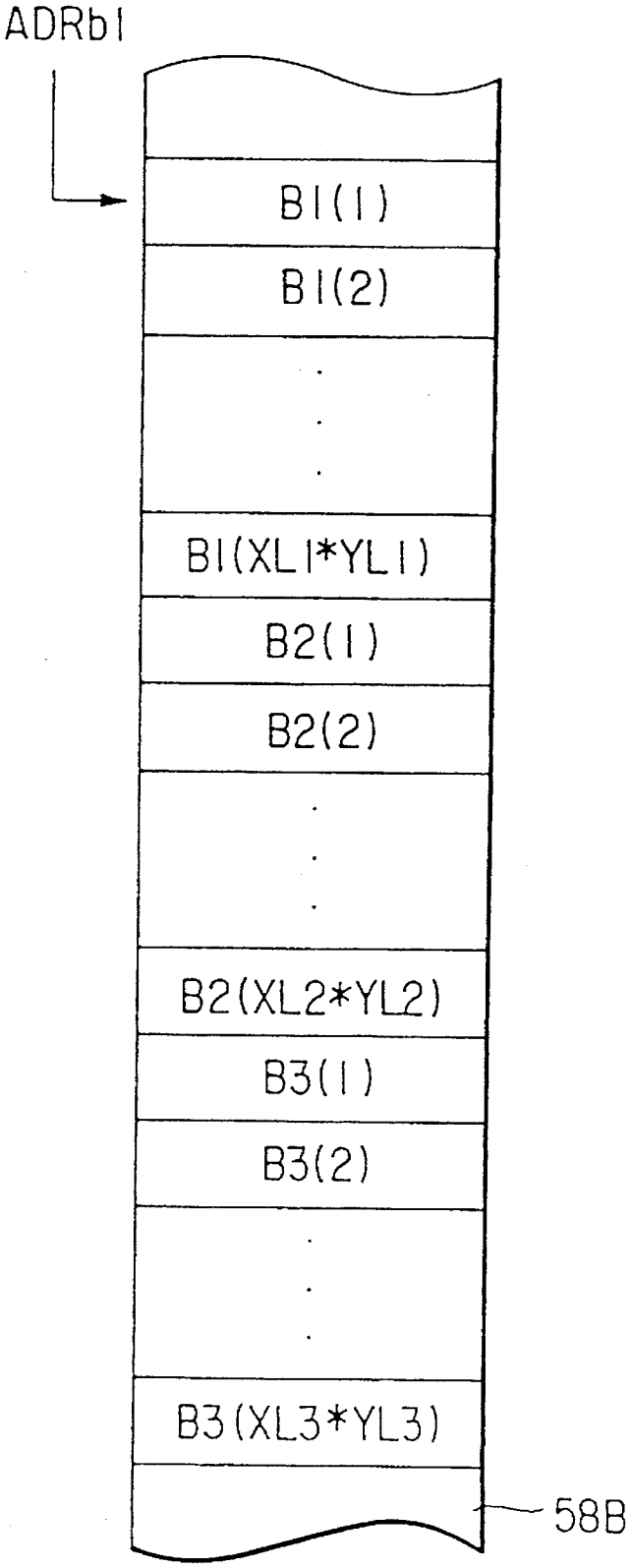
FIG. 31 is a chart showing an example of the arrangement of a blue feature pattern management table according to the third embodiment.

When, for example, access is made to address ADR1 in the feature management table 57 shown in FIG. 28, and to addresses ADRr1, ADRg1, and ADRb1 in the red, green, and blue feature pattern management tables 58R, 58G, and 58B, it is checked first whether red, green, and blue image data, on the check Q, indicated by positions (X1, Y1), (X2, Y2), and (X3, Y3), and sizes (XL1, XL1), (XL2, XL2), and (XL3, YL3) coincide with sets of three pieces of feature information R1, G1, B1, R2, G2, B2, R3, G3, and B3 corresponding to the first type of preregistered check.

If it is determined that all the pieces of feature information coincide with the corresponding image data, coordinate data {(XSi1, YSi1), (XEi1, YEi1)} indicating the position of the amount information area of this preregistered check is output, as coordinate data {(XS, YS), (XE, YE)} indicating the position of the amount information area of the check Q, to the amount area self-detecting section 82 through the register 95 by an interrupt operation (steps S104 to S111). The processing in this case is then completed.

If at least one of the sets of three pieces of feature information R1, G1, B1, R2, G2, B2, R3, G3, and B3 corresponding to the first type of preregistered check does not coincide with the corresponding information, it is checked whether the pieces of feature information on the check Q coincide with sets of two feature information R1, G1, B1, R2, G2, and B2 corresponding to the second type of preregistered check (steps S105 to S107).

If it is determined that the sets of two feature information coincide with the corresponding pieces of information, coordinate data {(XSi2, YSi2), (XEi2, YEi2)} indicating the position of the amount information area of this preregistered check is output as coordinate data {(XS, YS), (XE, YE)} indicating the position of the amount information area of the check Q in the same manner as described above.

If it is determined that at least one of the sets of two pieces of feature information does not coincide with the corresponding information, it is determined that the check Q is not a preregistered check. That is, processing of "m←m−1" is performed to set "m=0", and the processing in this case is then completed. A wait state is kept until the image of the next check Q is detected.

As described above, according to the third embodiment, by using a color image on a check, the same objects and effects as those of the second embodiment can be more effectively and reliably obtained.

The fourth embodiment of the present invention will be described next.

Similar to the first embodiment described above, in the fourth embodiment, the present invention is applied to a character reading apparatus for reading address information on mail. In the fourth embodiment, collation is performed by using an inherent actual image written on preregistered mail from a specific company so as to more accurately and reliably detect the address information area of the mail regardless of variable address information such as the address and name of an addressee. Since the fourth embodiment has almost the same arrangement as that of the first embodiment except for a reading section 4 (see FIG. 16.), only the reading section 4 will be described in detail below. The same reference numerals in the fourth embodiment denote the same parts as in the first embodiment, and a detailed description thereof will be omitted.

Figure 33:
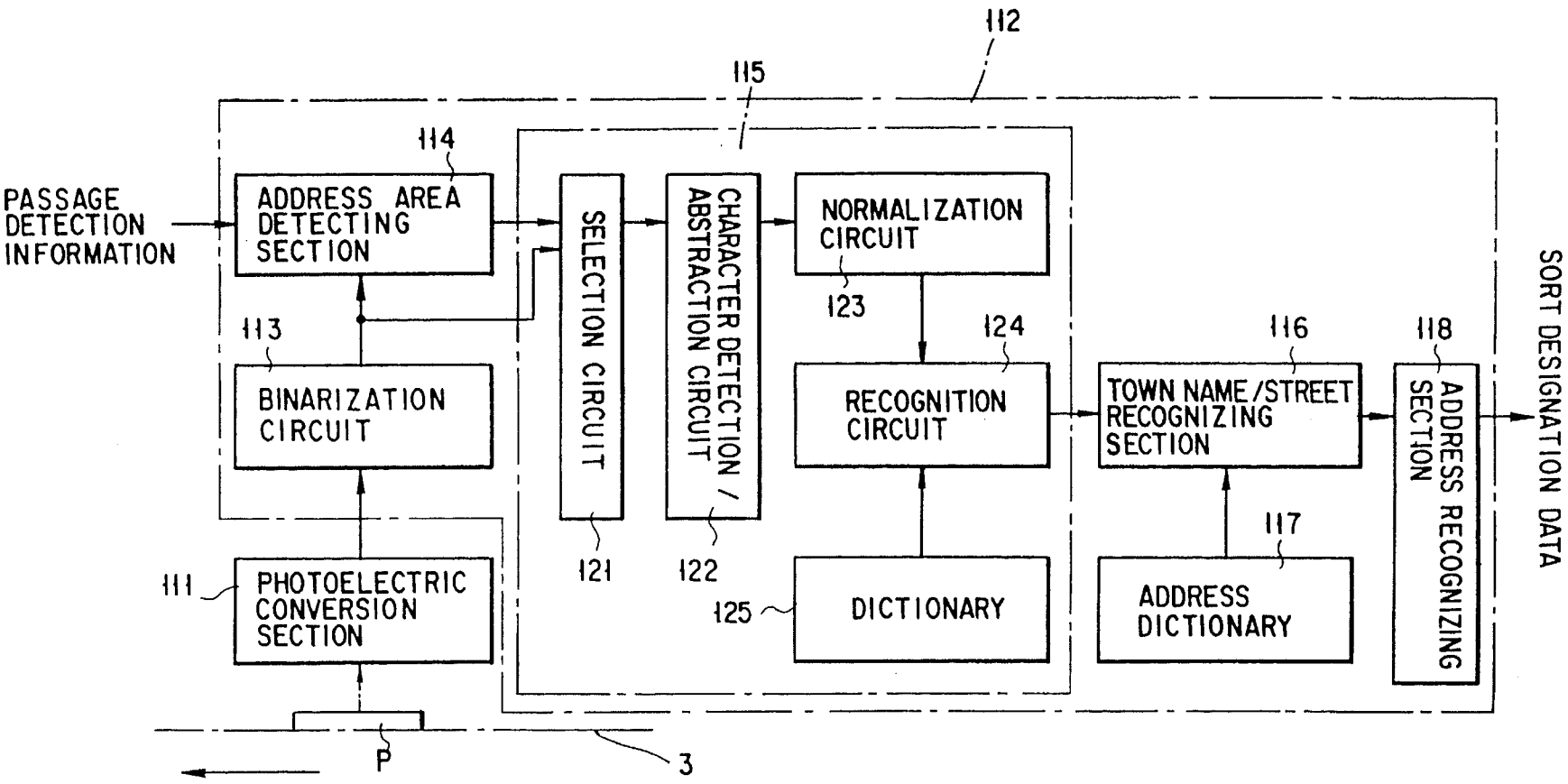
FIG. 33 is a block diagram schematically showing the arrangement of a reading section according to the fourth embodiment.

FIG. 33 schematically shows the arrangement of the reading section 4 according to the fourth embodiment. The reading section 4 comprises a photoelectric conversion section 111 and an identifying section 112. The photoelectric conversion section 111 optically obtains an image on the entire surface of mail P conveyed in the direction indicated by an arrow shown in FIG. 33, and photoelectrically converts the image. The identifying section 112 identifies address information by performing character pattern recognition in accordance with an output from the photoelectric conversion section 111.

The photoelectric conversion section 111 serves to obtain a pattern signal (read signal) by optically scanning the surface of the mail P on which address information is written, and performing photoelectric conversion. For example, the photoelectric conversion section 111 is constituted by a light source for radiating light onto the mail P and a self-scanning CCD type line sensor for receiving light reflected by the mail P and converting it into an electrical signal.

The identifying section 112 is constituted by a binarization circuit 113, an address area detecting section 114, a character recognizing section 115, a town name/street recognizing section 116, an address dictionary 117, and an address recognizing section 118.

The binarization circuit 113 serves to binarize a read signal from the photoelectric conversion section 111. A binary signal corresponding to the entire surface of the mail P and output from the binarization circuit 113 represents each pixel value (1 or 0) of the original image.

The address area detecting section 114 detects an area (read area), on which address information is written, from all the information written on the mail P, on the basis of the binary signal from the binarization circuit 113, and outputs data indicating the position of the address information area. A detection method used in this case will be described in detail later.

The character recognizing section 115 is constituted by a selection circuit 121, a character detection/abstraction circuit 122, a normalization circuit 123, and a recognition circuit 124. The selection circuit 121 outputs an image signal, of the binary signal from the binarization circuit 113, which corresponds to the data supplied from the address area detecting section 114 and indicating the position of the address information area. The character detection/abstraction circuit 122 detects and abstracts character information corresponding to the signal supplied from the selection circuit 121, i.e, the address information in the address information area, one-character information at a time. The normalization circuit 123 normalizes and samples the output from the character detection/abstraction circuit 122, i.e., the abstracted character information. The recognition circuit 124 performs character recognition with respect to the character information processed by the normalization circuit 123 by, for example, a matching method using reference patterns corresponding to character in a dictionary 125.

The town name/street recognizing section 116 serves to recognition of a town name and a street with respect to the recognized character supplied from the character recognizing section 115 by referring to address information preregistered in the address dictionary 117.

The address recognizing section 118 serves to recognize address information in accordance with the town name/street recognition result supplied from the town name/street recognizing section 116, and output sort designation data corresponding to the address information.

That is, the position of a pocket 8 in a sorting section 5 is indicated by this sort designation data, and the mail P corresponding to the sort designation data is sorted/collected in the pocket 8.

Figure 34:
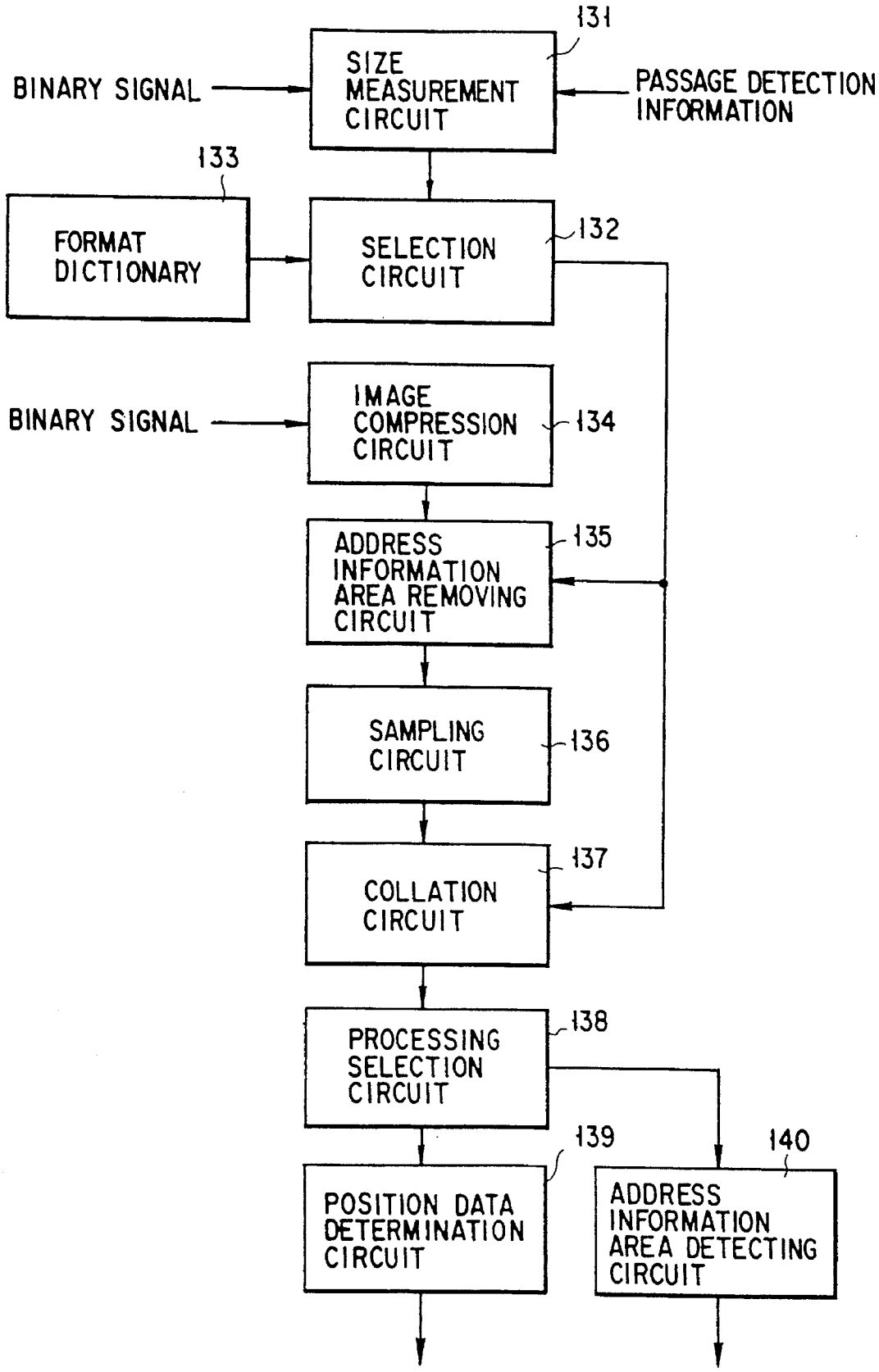
FIG. 34 is a block diagram schematically showing the arrangement of an address area detecting section according to the fourth embodiment.

FIG. 34 schematically shows the arrangement of the address area detecting section 114. The address area detecting section 114 comprises a size measurement circuit 131, a selection circuit 132, a format dictionary 133, an image compression circuit 134, an address information area removing circuit 135, a sampling circuit 136, a collating circuit 137, a processing selection circuit 138, a position data determination circuit 139, and an address information area detecting circuit 140.

The size measurement circuit 131 measures the vertical and horizontal lengths of the mail P on the basis of the binary signal from the binarization circuit 113 and passage detection information. In this case, the vertical length (length in the conveying direction) of the mail P is obtained from passage detection information, e.g., the time taken for the passage of the leading and trailing ends of the mail P, which is detected by a conveyance detector (not shown) arranged on a convex path 3, and the convey speed. The horizontal length (length in a direction perpendicular to the conveying direction) of the mail P is calculated by the ratio of the vertical length to the horizontal length of the binary signal as the input image (original image).

The selection circuit 132 selectively reads out only information associated with specific company mail, of pieces of information associated with preregistered specific company mail (to be described in detail later), which corresponds to the measurement result (the size of the mail P) from the size measurement circuit 131. For example, with regard to a postcard in a fixed form, all information, of the information associated with the preregistered specific company mail, which is associated with specific company mail having almost the same size as that of the postcard, is read out.

The format dictionary 133 serves to preregister information on specific company mail in advance. In this case, information preregistered in the format dictionary 133 will be described below with reference to the specific company mail shown in FIG. 35.

Figure 35:
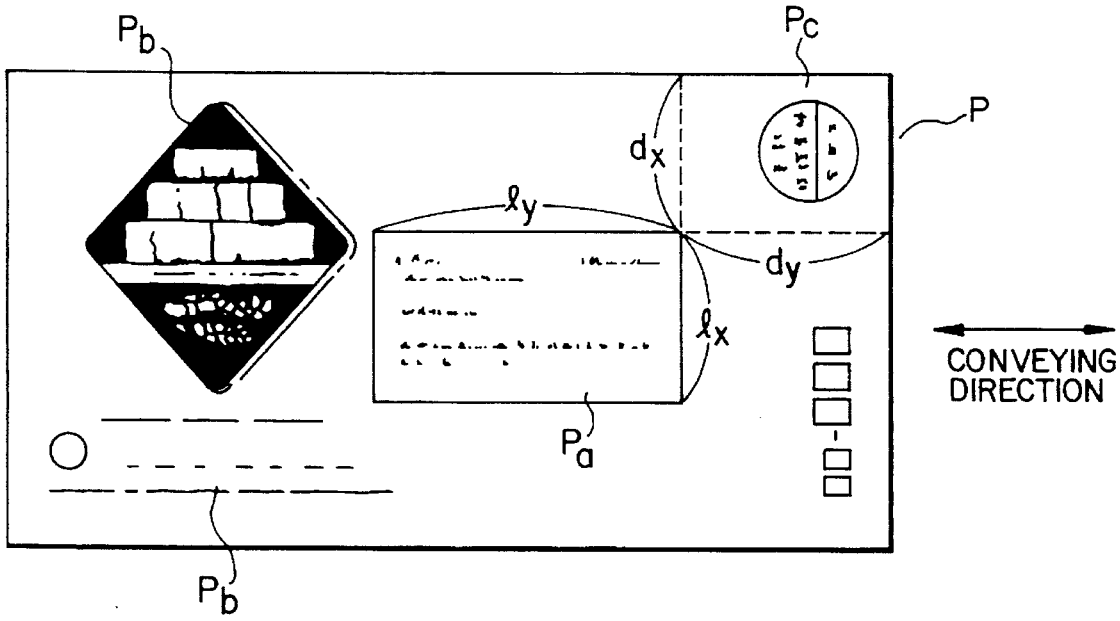
FIG. 35 is a view showing an example of specific company mail according to the fourth embodiment.

FIG. 35 shows an example of the specific company mail P. For example, this specific company mail is bulk mail, e.g., notifications of electricity charges or demands for payment of gas charges, which are mailed from a specific company in large quantities in the same format. In this case, in addition to address information Pa, an advertisement Pb and a postage stamp Pc are pre-printed on the surface on which the address information Pa is written.

Information about the specific company mail P preregistered in the format dictionary 133 includes, for example, the size of the specific company mail P, a compressed binary image (actual image), of the specific company mail P, which is stored in correspondence with the size, and information indicating the position of the address information area of the specific company mail P.

In this case, for example, the information indicating the position of the address information area is represented by four parameters, i.e., coordinates dx and dy of a vertex, of a rectangular area enclosing the address information Pa so as not to enclose the advertisement Pb, the postage stamp Pc, and the like located near the address information Pa, which is closest to the postage stamp Pc, a length lx of the area in a direction perpendicular to the conveying direction, and a length ly of the area in the conveying direction.

The image compression circuit 134 serves to compress the binary image from the binarization circuit 113 by a predetermined compression scheme.

The address information area removing circuit 135 converts portions corresponding to pieces of information indicating the address information areas, of the compressed images supplied from the image compression circuit 134, which are associated with several pieces of specific company mail P selected by the selection circuit 132 into white pixels (0), thereby removing the address information from the original image.

The sampling circuit 136 samples the original image supplied from the address information area removing circuit 135, from which the address information has been removed, by mask processing, thus absorbing vertical and horizontal variable components in the original image.

The collating circuit 137 collates the original image, which is supplied through the sampling circuit 136 and from which the address information has been removed, with the actual image of the specific company mail P, which is read out from the format dictionary 133, by a pattern matching method (a superposition method using binary images).

The processing selection circuit 138 calculates a similarity between the original image and the actual image on the basis of the collation result from the collating circuit 137, and checks on the basis of the calculated similarity whether the mail P corresponding to the original image is the specific company mail P corresponding to the actual image, thus selecting processing on the subsequent stage.

In this case, for example, the above-described series of operations are individually performed with respect to the several pieces of specific company mail P selected by the selection circuit 132, and similarities are calculated on the basis of the respective collation results by, e.g., a simple similarity method, a compound similarity method, or a method using a neutral network.

For example, the calculated similarities are then compared with a predetermined threshold value to determine the mail P to which preregistered specific company mail P is similar.

When it is determined by the processing selection circuit 138 that the mail P is similar to one of the preregistered specific company mail P, the position data determination circuit 139 outputs information indicating the position of the address information area of the specific company mail P as position data indicating the address information area of the mail P.

When the processing selection circuit 138 determines that the mail P is not similar to any specific company mail P, i.e., that the original image is not similar to any one of the actual images of the specific company mail P, and no similarity satisfying the threshold value is calculated, the address information area detecting circuit 140 performs a general detection algorithm, e.g., dividing the information on the mail P into blocks by obtaining a projection of the binary image, and detecting a probable address information area on the basis of the numbers of lines and character in each block.

Figure 36:
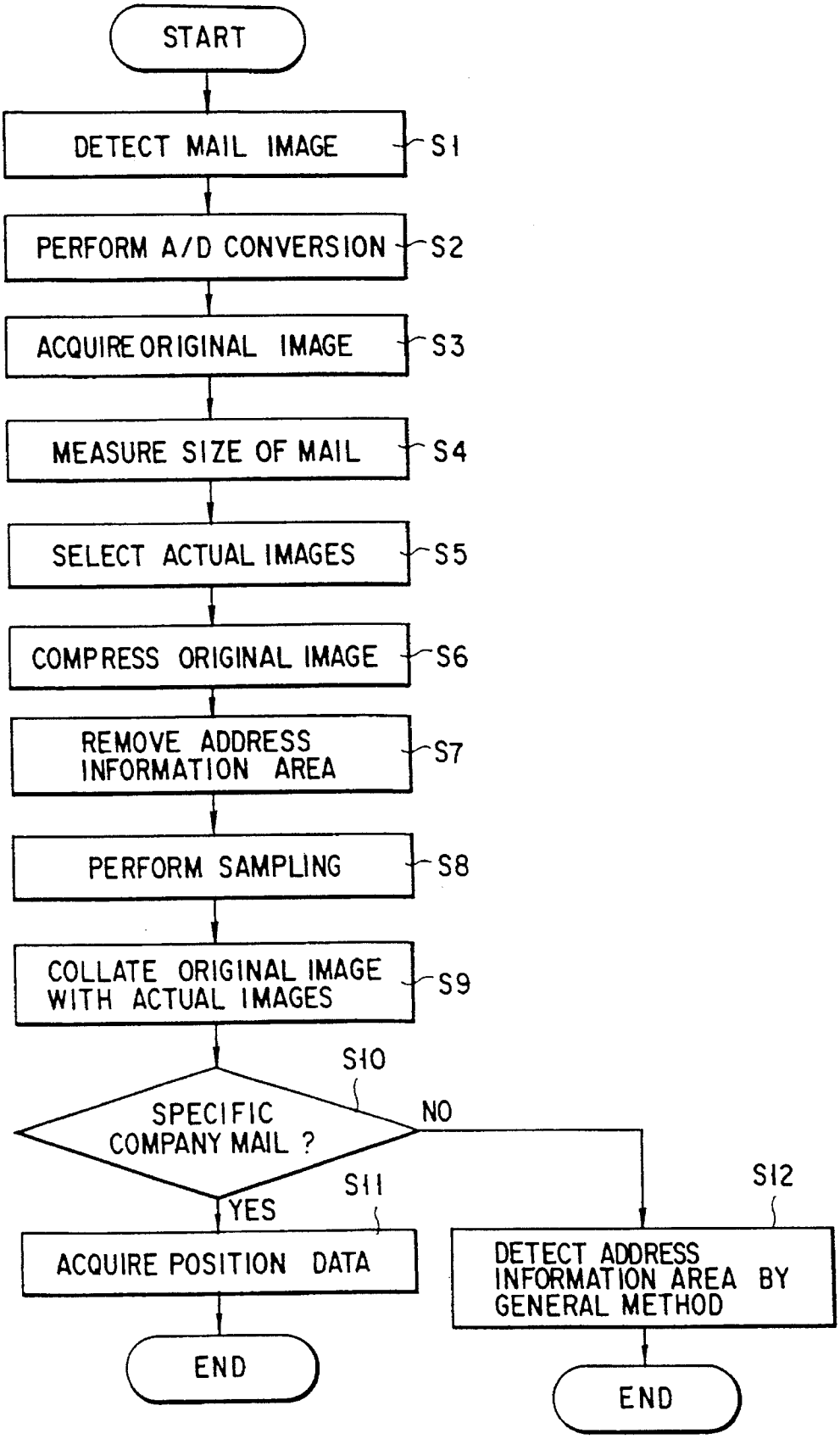
FIG. 36 is a flow chart for explaining an outline of an operation.
Figure 37A:
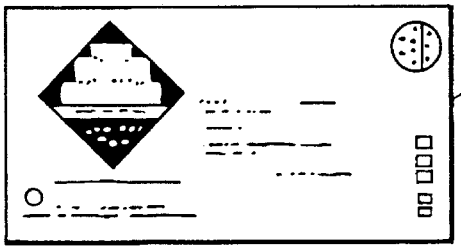
FIGS. 37(*a*)–37(*f*) illustrate the operation of the present invention.
Figure 37B:
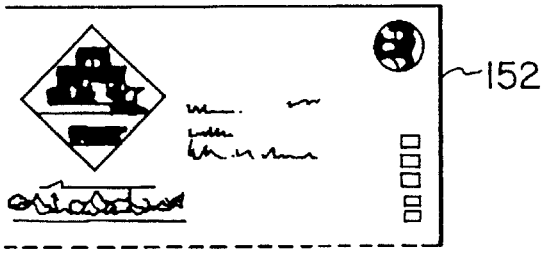
Figure 37C:
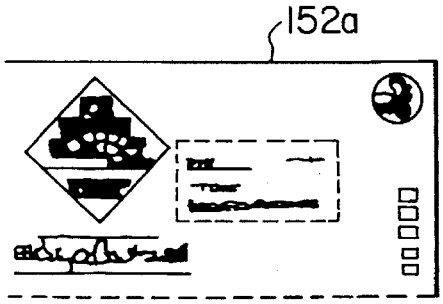
Figure 37D:
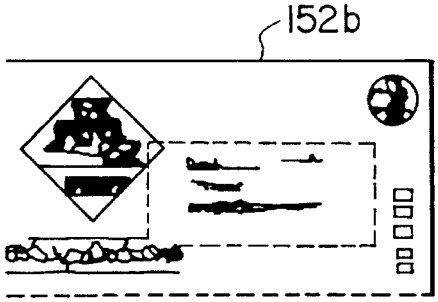
Figure 37E:
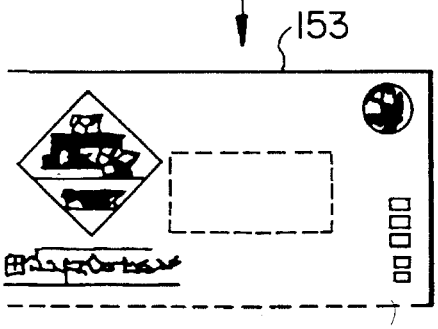
Figure 37F:
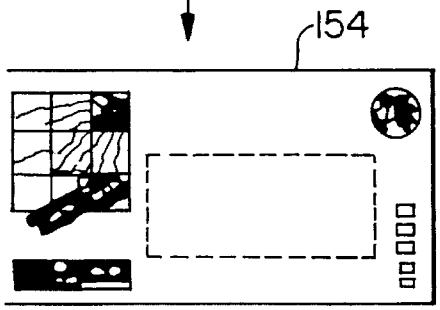

An operation associated with detection of an address information area will be described next with reference to FIGS. 36 and 37(*a*)–37(*f*). FIG. 36 schematically shows the flow of processing from detection of an image of mail to detection of an address information area. FIGS. 37(*a*)–37(*f*) shows the manner of processing the image of the mail in the processing.

First, an overall image on the mail P conveyed through the take-in convey path 3 is detected by the photoelectric conversion section 111 (step S1). A pattern signal 151 (see FIG. 37(*a*) corresponding to the detected image of the mail P is binarized by the binarization circuit 113 in the identifying section 112 and is A/D-converted (step S2) into an original image (step S3).

After the size of the mail P is obtained by the size measurement circuit 131 in the address area detecting section 114 (step S4), several pieces of information on the specific company mail P preregistered in the format dictionary 133 are selected, and actual images to be used for the subsequent collation processing are selected (step S5).

The original image corresponding to the mail P is compressed by the image compression circuit 134 in the address area detecting section 114 to a degree required for the subsequent collation processing (step S6), and is converted into a compressed image 152, as shown at FIG. 37(*b*). Thereafter, information corresponding to the address information area on each actual image selected from the format dictionary 133 is removed from the compressed image 152 by the address information area removing circuit 135 (step S7).

Assume that first and second types of actual images 153 and 154 are selected from the format dictionary 133, as shown in FIGS. 37(*a*)–37(*f*). In this case, the address information area removing circuit 135 removes information, of the compressed image 152, which corresponds to the position of the address information area (enclosed with a broken line shown in FIGS. 37(*c*)–37(*f*) of the first actual image 153.

An original image 152*a* (see FIG. 37(*c*), from which the information on the portion corresponding to the address information area of the first actual image 153 has been removed, is sampled by the sampling circuit 136 by using, e.g., a Gaussian filter (step S8) to be converted into an image having the same pixel count as that of the first actual image 153.

Subsequently, the collating circuit 137 collates the original image 152*a* with the first actual image 153 by the pattern matching method or the like (step S9). In addition, the processing selection circuit 138 calculates a similarity between the original image 152*a* and the first actual image 153.

Similarly, the address information area removing circuit 135 removes information, of the compressed image 152, which corresponds to the position of the address information area (enclosed with the broken line shown in FIG. 37 (*e*) of the second actual image 154. An original image 152*b* (see FIG. 37(*d*), from which the information of the portion corresponding to the address information area of the second actual image 154 has been removed, is sequentially subjected to sampling processing in the sampling circuit 136, collation processing in the collating circuit 137, and similarity processing in the processing selection circuit 138.

When similarities to the respective actual images are obtained in this manner, it is checked which similarity is highest and whether the similarity is higher than the threshold value, thereby determining whether the mail P is identical to the specific company mail P corresponding to the actual image exhibiting the highest similarity (step S10).

If it is determined in the processing selection circuit 138 that the mail P is identical to the specific company mail P, the position data determination circuit 139 reads out information (position data) indicating the position of the address information area of the specific company mail P from the format dictionary 133 (step S11).

The information is then output, as position data indicating the address information area of the mail P, to the selection circuit 121 in the character recognizing section 115. If, for example, the similarity to the first actual image is higher than that to the second actual image, and the similarity exceeds the threshold value, it is determined that the mail P is identical to the specific company mail P corresponding to the first actual image 153. As a result, the information preregistered as the information indicating the address information area of the specific company mail P is output as position data.

In this manner, collation of portions other than address information areas, which vary depending on the addresses and names of addressees, is performed by using the actual images of the preregistered specific company mail P to detect the address information area of the mail P. Therefore, the address information area of the mail P can be more accurately detected without being influenced by variable address information.

Note that if it is determined that the mail P is not identical to the preregistered specific company mail P, an address information area is detected by a method using a general detection algorithm, as described above (step S12).

As described above, an address information area can be specified from the fixed features on mail. That is, the actual image of preregistered specific company mail is collated with an original image of read mail excluding the address information area to determine whether the mail is identical to the specific company mail. In addition, if it is determined that the mail is identical to the specific company mail, the address information area of the mail is specified by the address information area of the specific company mail.

With this operation, since the address information area of the mail can be more accurately detected without being influenced by address information which may vary depending on an addressee, the precision of detection of an address information area can be improved.

In addition, since candidates for specific company mail to be collated are selected in accordance with the size of mail, collation can be performed within a shorter period of time by using a limited quantity of specific company mail, thus allowing efficient detection of an address information area.

Furthermore, in sorting specific company mail which is mailed in large quantities in the same format, an operation of switching preregistered contents for each format can be automated, which has been impossible to realize in practice. Therefore, the load on an operator and the required skill can be reduced, and efficient sorting can be performed.

Consequently, the precision of detecting an address information area and the efficiency of operation can be improved. In addition, the overall performance can be improved.

In the fourth embodiment, the present invention is applied to an automatic mail address reading/sorting apparatus. However, the present invention is not limited to this. For example, the present invention can be equally applied to a general optical character reading apparatus and various character reading apparatuses using a two-dimensional image input apparatus and the like.

In addition, the present invention is not limited to the technique of converting preregistered information and read information into compressed images and collating them with each other. For example, images before compression processing may be used. In this case, the number of steps can be decreased to allow an effective operation.

As has been described in detail above, according to the present invention, there is provided a character reading apparatus which can efficiently and accurately detect a read area and can be suitably used for an automatic apparatus such as an automatic address reading/sorting apparatus, reading of specific information from securities, or the like.

In addition, according to the present invention, there is provided a character reading apparatus which can achieve an improvement in operability and processing efficiency and reduce the load on an operator, and which can be suitably used for reading of address information from specific mail, reading of specific information from securities, or the like.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A postal matter address reading apparatus comprising:

means for obtaining an image of an unknown postal matter, the image having an address area;

means for storing, as a first set of information, a size of a first known postal matter, a first known image representative of the first known postal matter, and a position of an address area on the first known postal matter and for storing, as a second set of information, a size of a second known postal matter, a second known image representative of the second known postal matter, and a position of an address area on the second known postal matter;

means for measuring a size of the unknown postal matter;

means for selecting one of the first known image and the second known image based on the size of the unknown postal matter;

means for removing the address area from the image of the unknown postal matter based on the position of the address associated with the selected one of the first and the second known images;

means for comparing the image of the unknown postal matter having the address area removed therefrom with the selected one the first and the second known image to determine a degree of identity therebetween; and means for reading character information included in image of the unknown postal matter located at the position of the address associated with the selected one of the first and the second known images if it is determined that there is a sufficient identify between the image of the unknown postal matter having the address area removed therefrom and the selected one of the first and the second known images.

2. A postal matter address reading apparatus according to claim 1, further comprising a means for operating upon the image of the unknown postal matter so that a number of pixels in the image of the unknown postal matter is the same as a number of pixels in the selected one of the first and second known images.

3. A postal matter address reading apparatus according to claim 1, wherein the means for comparing compares the image of the unknown postal matter having the address area removed with the selected one of the first and second known images using pattern matching.

4. A postal matter address reading apparatus according to claim 3, wherein the means for comparing determines that identity exists between the image of the unknown postal matter having the address area removed therefrom and the selected one of the first and second known images if similarities therebetween reach a predetermined threshold value.

5. A postal matter address reading apparatus according to claim 1, wherein the first and the second known images correspond to actual images of the first and the second known postal matters, the means for removing the address area from the image of the unknown postal matter also removes the address area from the selected one of the first and the second known images, and the means for comparing compares the image of the unknown postal matter having the address area removed therefrom with the selected one the first and the second known images having the address area also removed therefrom to determine the degree of identity therebetween.

6. A postal matter address reading apparatus according to claim 1, further comprising an address information detecting means for detecting the address of the unknown postal matter using an area detecting circuit if it is determined that there is an insufficient degree of identify between the image of the unknown postal matter having the address area removed therefrom and the selected one of the first and the second known images.

7. A postal matter address reading apparatus comprising:

means for obtaining an image of an unknown postal matter, the image having an address area;

means for storing a plurality of sets of information, each set of information including a size of a known postal matter, an image representative of the known postal matter, and a position of an address area on the known postal matter;

means for measuring a size of the unknown postal matter;

means for selecting a first known image and a second known image from the plurality of sets of information in the storing means if the size of a first known postal matter associated with the first known image in a first set of information and a size of a second known postal matter associated with the second known image in a second set of information are substantially similar to a size of the unknown postal matter;

means for removing the address area from the image of the unknown postal matter based on the position of the address associated with the first known image to generate a first unknown image and for removing the address area from the image of the unknown postal matter based on the position of the address associated with the second known image to generate a second unknown image;

means for comparing the first unknown image with the first known image to determine a degree of identity therebetween and for comparing the second unknown image with the second known image to determine a degree of identity therebetween; and means for reading character information included in the image of the unknown postal matter located at the position of the address associated with the first known images if it is determined that the degree of identify between the first unknown image and the first known image is greater than the degree of identity between the second unknown image and the second known image.

8. A postal matter address reading apparatus according to claim 7, further comprising means for operating upon the image of the unknown postal matter so that a number of pixels in the image of the unknown postal matter is the same as a number of pixels in the first known image.

9. A postal matter address reading apparatus according to claim 7, further comprising means for operating upon the image of the unknown postal matter so that a number of pixels in the image of the unknown postal matter is the same as a number of pixels in the second known image.

10. A postal matter address reading apparatus according to claim 7, wherein the means for comparing compares the image of the unknown postal matter having the address area removed with the first and the second known images using pattern matching.

11. A postal matter address reading apparatus according to claim 7, wherein the first and the second known images correspond to actual images of the first and the second known postal matters, the means for removing the address area from the image of the unknown postal matter also removes the address area from the first and the second known images, and the means for comparing compares the first unknown image with the first known image having the address area removed therefrom to determine the degree of identity therebetween and compares the second unknown image with the second known image having the address area removed therefrom to determine the degree of identity therebetween.

12. A postal matter address reading apparatus comprising:

an optical scanning system that generates an image of an unknown postal matter, the image having an address area;

a memory storing, as a first set of information, a size of a first known postal matter, a first known image representative of the first known postal matter, and a position of an address area on the first known postal matter and for storing, as a second set of information, a size of a second known postal matter, a second known image representative of the second known postal matter, and a position of an address area on the second known postal matter;

a device that measures a size of the unknown postal matter based on the image of an unknown postal matter; and a processing unit that performs the following operations:

selects one of the first known image and the second known image based on the size of the unknown postal matter;

removes the address area from the image of the unknown postal matter based on the position of the address associated with the selected one of the first and the second known images;

compares the image of the unknown postal matter having the address area removed therefrom with the selected one the first and the second known image to determine a degree of identity therebetween; and reads character information included in the image of the unknown postal matter located at the position of the address associated with the selected one of the first and the second known images if it is determined that there is a sufficient identify between the image of the unknown postal matter having the address area removed therefrom and the selected one of the first and the second known images.

* * * * *